US008098224B2

(12) United States Patent
Washio et al.

(10) Patent No.: US 8,098,224 B2
(45) Date of Patent: Jan. 17, 2012

(54) DRIVER CIRCUIT FOR DISPLAY DEVICE AND DISPLAY DEVICE

(75) Inventors: Hajime Washio, Sakurai (JP); Yuhichiroh Murakami, Matsusaka (JP); Seijirou Gyouten, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1071 days.

(21) Appl. No.: 11/052,789

(22) Filed: Feb. 9, 2005

(65) Prior Publication Data

US 2005/0174865 A1 Aug. 11, 2005

(30) Foreign Application Priority Data

Feb. 10, 2004 (JP) ..... 2004-034045

(51) Int. Cl.
*G09G 3/36* (2006.01)

(52) U.S. Cl. ..... 345/100; 377/64

(58) Field of Classification Search ..... 345/98–100, 345/21–213, 690; 327/333; 377/64, 78, 377/80

See application file for complete search history.

(56) References Cited

U.S. PATENT DOCUMENTS

| | | | | |
|---|---|---|---|---|
| 4,641,384 | A * | 2/1987 | Landsberger et al. | 4/620 |
| 5,218,238 | A * | 6/1993 | Nonaka et al. | 327/530 |
| 5,686,936 | A | 11/1997 | Maekawa et al. | |
| 5,959,600 | A | 9/1999 | Uchino et al. | |
| 6,492,972 | B1 | 12/2002 | Kubota et al. | |
| 6,724,361 | B1 | 4/2004 | Washio et al. | |
| 6,731,266 | B1 | 5/2004 | Jung | |
| 6,930,662 | B2 * | 8/2005 | Aoki | 345/87 |
| 2002/0041278 | A1 * | 4/2002 | Matsueda | 345/204 |
| 2003/0234761 | A1 | 12/2003 | Washio et al. | |
| 2004/0174334 | A1 | 9/2004 | Washio et al. | |
| 2005/0077925 | A1 * | 4/2005 | Bernardson | 327/98 |

FOREIGN PATENT DOCUMENTS

| | | | |
|---|---|---|---|
| EP | 1128356 | A2 * | 8/2001 |
| JP | 7-333654 | A | 12/1995 |
| JP | 11-218738 | A | 8/1999 |
| JP | 11-272226 | A | 10/1999 |
| JP | 2000-20028 | A | 1/2000 |
| JP | 2000-206491 | A | 7/2000 |
| JP | 2000-339985 | A | 12/2000 |
| JP | 2001-051252 | A | 2/2001 |

* cited by examiner

*Primary Examiner* — Amr Awad
*Assistant Examiner* — Michael Pervan
(74) *Attorney, Agent, or Firm* — Harness, Dickey & Pierce, P.L.C.

(57) ABSTRACT

A driver circuit for a display device includes NOR circuits on the input side of switches for controlling precharge of data signal lines and selected pixels connected to the data signal lines. While a video signal is written onto a data signal line, a signal instructing precharge of another data signal line is inputted from a shift register to the NOR circuits. A simultaneous precharge instruction signal is inputted from outside to the NOR circuits. According to this arrangement, precharge is performed in both a period in which a video signal is supplied to a data signal line and a period in which no video signal is supplied to any of the data signal lines. As a result, it is possible to perform precharge even with a precharge power source having relatively low driving capability, and to precharge the signal supply lines of the display device sufficiently.

16 Claims, 28 Drawing Sheets

DRIVER CIRCUIT FOR DISPLAY DEVICE AND DISPLAY DEVICE

This Nonprovisional application claims priority under 35 U.S.C. §119(a) on Patent Application No. 034045/2004 filed in Japan on Feb. 10, 2004, the entire contents of which are hereby incorporated by reference.

FIELD OF THE INVENTION

The present invention relates to a driver circuit that precharges signal supply lines of a display device before supplying signals thereto, and relates to a display device.

BACKGROUND OF THE INVENTION

In driving a liquid crystal panel by alternating driving, an active matrix liquid crystal display device, which performs dot sequential driving, precharges signal lines before supplying video signals to pixels through data signal lines. This makes it possible to charge the pixels by predetermined amounts stably. In this case, in order to adopt a driving method in which all signal lines are precharged simultaneously (hereinafter "simultaneous precharge method"), a precharge power source must have high driving capability. This is because the sum of wire capacity of all signal lines is large. To solve this problem, there is a driving method in which precharge is performed unit by unit, each unit including a small number of signal lines (hereinafter "sequential precharge method").

For example, Patent Publication 1 (Japanese Publication for Laid-Open Patent Application, Tokukaihei 7-295520; corresponding to U.S. Pat. No. 5,686,936) discloses an arrangement in which, in outputting a video signal to one data signal line, a switch of another data signal line is turned ON by using a video-signal-sampling signal outputted from a shift register of a data signal line driver, so as to perform precharge by using a precharge power source.

Patent Publication 2 (Japanese Publication for Laid-Open Patent Application, Tokukai 2000-89194; corresponding to U.S. Pat. No. 6,731,266B1) discloses an arrangement in which all data signal lines are divided onto several blocks including data signal lines, and, in outputting video signals from a data signal line driver to data signal lines of an n-th data signal line block, data signal lines of an (n+1)-th data signal line block are precharged by a precharge power source by using video-signal-sampling signals.

Patent Publication 3 (Japanese Publication for Laid-Open Patent Application, Tokukai 2000-206491) discloses an arrangement in which a transfer pulse input of each transfer stage of a data signal line driver is used as a timing pulse for opening or closing an analog switch for precharging the data signal line of the transfer stage and also used, by being delayed from the timing pulse for precharge, as a timing pulse for opening or closing an analog switch for outputting substantive data (video signal) to the data signal line. A transfer pulse output of the transfer stage is used as a transfer pulse input of a next transfer stage, and as a timing pulse for precharge and a timing pulse for substantive data output of the next transfer stage.

In order to output video signals from these data signal line drivers to data signal lines by a dot-sequential method, each data signal line is provided with a switch having a capacitor-type control terminal (e.g. a gate) such as MOSFET including a TFT, and the switch is switched dot sequentially between conductive and nonconductive by controlling the charge voltage of the control terminal. A control signal for dot sequentially switching the switch is outputted after being shifted in a horizontal direction by a shift register generally including plural stages of flip-flops. A similar switch, which is switched dot sequentially between conductive and nonconductive so as to precharge the data signal lines, is provided separately.

According to the arrangements of the foregoing publications, a circuit for performing precharge is provided inside the data signal line driver, so that the frame of the liquid crystal display device has sufficient area, for example. As a result, the area of the precharge circuit can be reduced.

Patent Publication 4 (Japanese Publication for Laid-Open Patent Application, Tokukai 2001-135093; corresponding to U.S. Pat. No. 6,724,361B1), which is a publication for a laid-open patent application filed by the applicant of the present invention, discloses an arrangement in which a clock signal is taken onto a switch circuit upon receiving an output signal from a set-reset flip-flop of each stage of the shift register, and the clock signal is used as a set signal for a set-reset flip-flop of a next stage. Patent Publication 5 (Japanese Publication for Laid-Open Patent Application, Tokukai 2001-307495; corresponding to U.S. Pat. No. 6,724,361B1) and Patent Publication 6 (Japanese Publication for Laid-Open Patent Application, Tokukai 2000-339985), which are publications for laid-open patent applications filed by the applicant of the present invention, disclose an arrangement in which a clock signal is taken in upon receiving an output from a set-reset flip-flop of each stage of the shift register, and the clock signal is subjected to level shift and used as a set signal for a set-reset flip-flop of a next stage.

Patent Publication 7 (U.S. Patent Application Publication, No. 023461/2003), which is a publication for a laid-open patent application filed by the applicant of the present invention, discloses an arrangement of providing a precharge circuit and a shift register. While write signals are written by a write circuit onto a part of signal supply lines, the precharge circuit precharges the rest of the signal supply lines. The shift register includes a control signal supply circuit for outputting a precharge control signal, which controls conductivity (conductive or non conductive) of a second switch, to a second control terminal through a second signal line, which is separated from a first signal line for transmitting the timing pulse to a first control terminal.

However, according to the sequential precharge method of Patent Publications 1 to 3 and 7, it is impossible to supply precharge potential to source bus lines when supply of video signals to the source bus lines (hereinafter referred to as "scanning", when appropriate) is stopped.

FIG. 27 illustrates driving waveforms in a normal scanning state (in which a video signal is supplied to each source bus line) of a display device that precharges a plurality of source bus lines by the conventional simultaneous precharge method. Here, the driving waveforms are those of three adjacent source bus lines SL1, SL2, and SL3. SSP is a start pulse of the source, SCK is a source clock signal, and PCTL is a precharge instruction signal instructing the timing for performing simultaneous precharge of the source bus lines. SMP1, SMP2, and SMP3 are sampling timing signals instructing the timing for sampling the video signals to the three adjacent source bus lines SL1 to SL3, respectively. VSL1, VSL2, and VSL3 are potentials of the source bus lines SL1 to SL3, respectively.

Operation for precharge is as follows. In time t1 to t2, the precharge instruction signal PCTL is effective (is High) and precharge potentials are supplied to the source bus lines SL1 to SL3, respectively. Then, in response to the input of the start pulse SSP (transition to High), scanning at a speed in accordance with the clock signal SCK is started, and video signals are supplied to the source bus lines SL1 to SL3 in accordance with the sampling timing signals SMP1 to SMP3, respectively.

In the simultaneous precharge method, as shown in FIG. 28, for example, in order to fix the potentials of the source bus lines to a desired potential when scanning is suspended, control is performed so that precharge is performed in accordance with the instruction signal PCTL during t7 to t8. In this way, it is possible to always supply potentials to the source bus lines. More specifically, the precharge instruction signal is High during a period from t1 to t2, which is before periods from t3 to t6 for supplying video signals to the source bus lines SL1 to SL3, and during a period from t7 to t8, which is after periods from t3 to t6 for supplying video signals. Therefore, precharge potentials are respectively supplied to the source bus lines SL1 to SL3 during the period from t1 to t2 and the period from t7 to t8. That is, during the periods in which video signals are not supplied to the source bus lines SL1 to SL3, the source bus lines SL1 to SL3 are precharged simultaneously. As a result, the potentials of the source bus lines SL1 to SL3 are always kept to be not lower than a desired potential. Thus, in the simultaneous precharge method, it is possible to supply precharge potentials to the source bus lines even when scanning is suspended.

FIG. 29 illustrates a normal scanning state of the case in which the sequential precharge method is adopted. In the sequential precharge method, precharge potentials are supplied sequentially to the source bus lines in the normal scanning state of FIG. 29.

However, in the sequential precharge method, it is impossible to supply precharge potentials to the source bus lines when scanning is suspended as in FIG. 28, for example. Therefore, in the sequential precharge method, there is a possibility that a precharge potential is supplied to a source bus line only for a very short period, making it impossible to charge the source bus line sufficiently.

Patent Publication 4 to 6 have no disclosure or suggestion concerning precharge.

SUMMARY OF THE INVENTION

The present invention was made in view of the foregoing conventional problems. An object of the present invention is therefore to provide a driver circuit that can precharge signal supply lines of a display device sufficiently even with a precharge power source having relatively low driving capability, and to provide a display device using the driver circuit.

To attain the foregoing object, a driver circuit for a display devise in accordance with the present invention is a driver circuit for a display device including a plurality of signal supply lines, the driver circuit including: a write circuit for writing write signals onto the signal supply lines line by line or by units of lines; and a precharge circuit for precharging the signal supply lines, while a write signal is written by the write circuit onto a signal supply line, the precharge circuit precharging another signal supply line, and, while no write signal is written by the write circuit onto any of the signal supply lines, the precharge circuit precharging the signal supply lines simultaneously.

According to this invention, while a write signal is written by the write circuit onto a signal supply line, the precharge circuit precharges another signal supply line, and, while no write signal is written by the write circuit onto any of the signal supply lines, the precharge circuit precharges the signal supply lines simultaneously. With this arrangement, precharge is performed for a longer time than in a case in which precharge is performed only while writing of write signals onto signal supply lines is suspended or a case in which, while a write signal is written by the write circuit onto a signal supply line, another signal supply line is precharged. As a result, it is possible to precharge the signal supply lines sufficiently.

In addition, according to this invention, the amount of charge that should be supplied to the signal supply lines while the writing of write signals onto the signal supply lines is suspended is smaller than in a case in which precharge is performed only while the writing of write signals onto the signal supply lines is suspended. As a result, it is possible to precharge the signal supply lines even with a precharge power source having relatively low driving capability.

For a fuller understanding of the nature and advantages of the invention, reference should be made to the ensuing detailed description taken in conjunction with the accompanying drawings.

DESCRIPTION OF THE EMBODIMENTS

Embodiment 1

With reference to FIGS. 1 to 5, the following describes one embodiment of the present invention.

Figure 1:
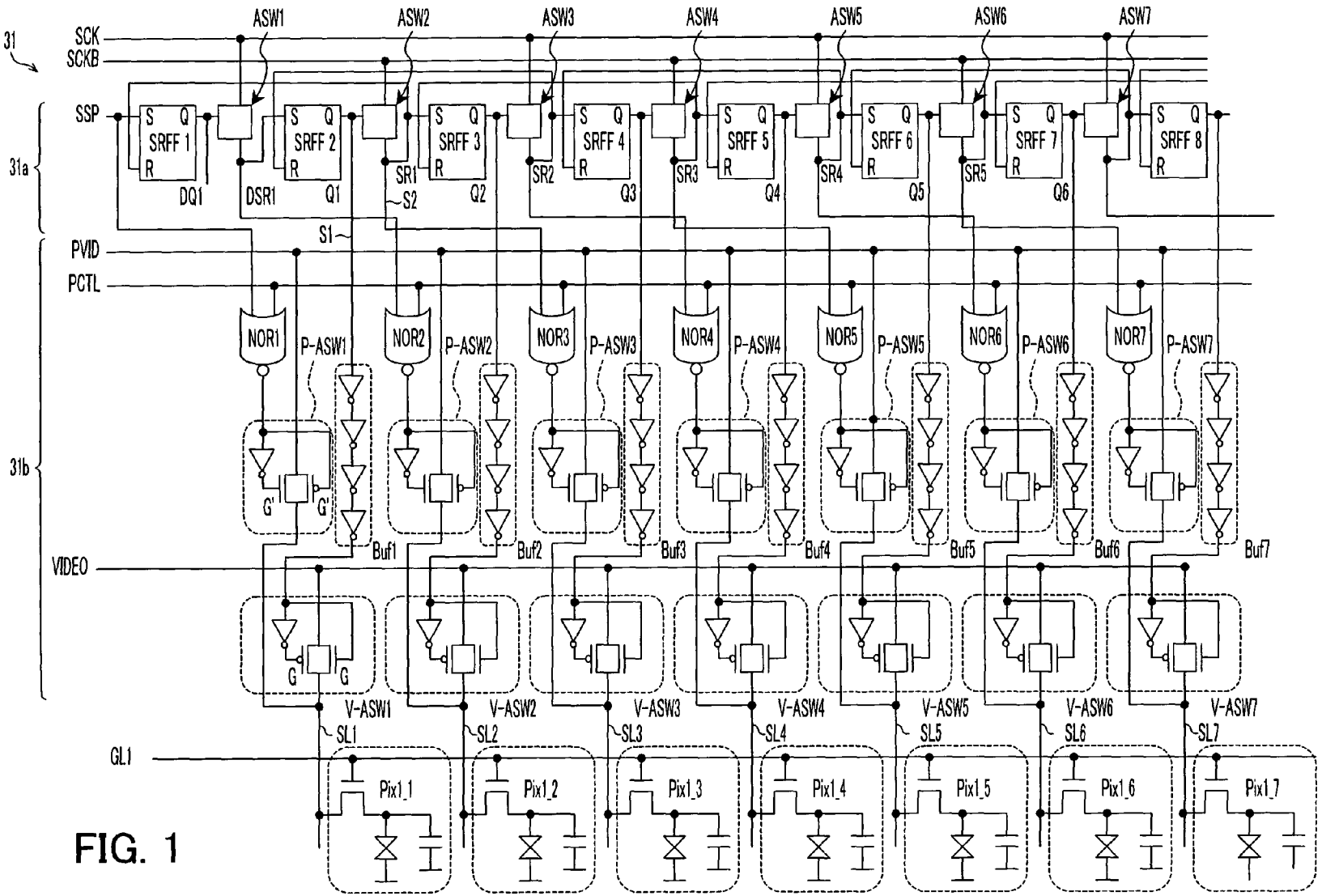
FIG. 1 is a circuit block diagram illustrating an arrangement of a data signal line driver of a first embodiment of the present invention.

A driver circuit for a display device in accordance with the present embodiment is a data signal line driver for a liquid crystal display device. FIG. 1 illustrates an arrangement of a data signal line driver 31.

The data signal line driver 31 includes a shift register 31*a* and a sampling section 31*b*.

The shift register 31*a* includes plural stages of set-reset-type flip-flops SRFF1, SRFF2, . . . , and a plurality of switching circuits (control signal supply circuits) ASW1, ASW2, . . . . A switching circuit ASWk (k=1, 2, . . . ) uses a Q-output of a flip-flop SRFFk as a control signal for controlling the conductivity (conductive or nonconductive) of the switching circuit ASWk. If k is an odd number, the switching circuit ASWk, when it becomes conductive, takes in and outputs a clock signal (first precharge control signal (signal for triggering precharge)) SCK, which is supplied from an external supply source that is different from a supply source of a timing pulse (described later). If k is an even number, the switching circuit ASWk, when it becomes conductive, takes in and outputs a clock signal (first precharge control signal) SCKB, which is also supplied from an external supply source that is different from the supply source of the timing pulse. The clock signal SCKB is an inversion signal of the clock signal SCK.

The switching circuits ASW1, ASW2, . . . output the clock signals SCK and SCKB (output signals SR1, SR2, . . . described later) to NOR circuits NOR2, NOR3, . . . (described later) through signal lines (second signal lines) S2, which are separated from signal lines (first signal lines) S1, through which Q-outputs of the flip-flops SRFFk are transmitted to switches V-ASWn (described later). The switching circuits ASW1, ASW2, . . . take in the clock signals SCK and SCKB from the external supply source through signal lines that are separated from the signal lines (first signal lines) through which the Q-outputs of the flip-flops SRFFk are transmitted to the switches V-ASWn (described later).

The switching circuit ASW1 outputs an output signal DSR1, and the switching circuits ASW2, ASW3, . . . output output signals SR1, SR2, . . . , respectively. The output of each switching circuit ASWk becomes a set signal for a flip-flop SRFF(k+1) and an input signal for an NOR circuit NOR(k+1) (described later).

Figure 2:
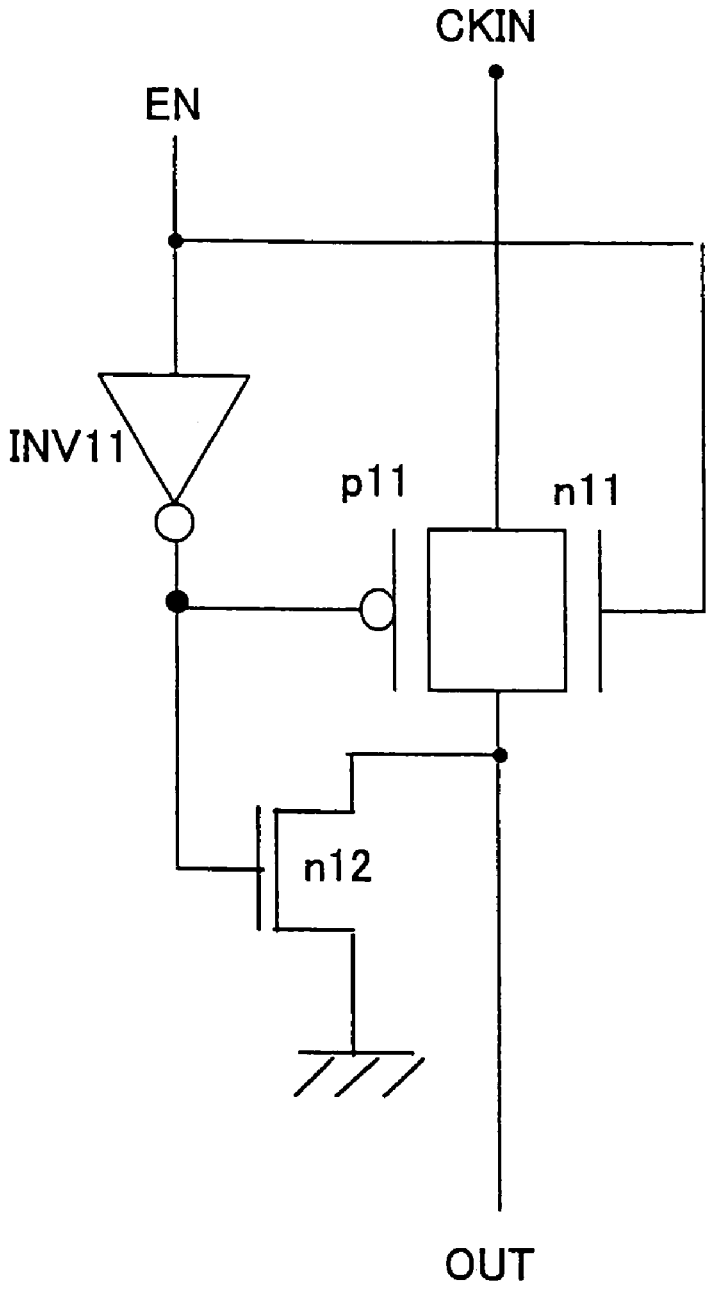
FIG. 2 Prior Art
FIG. 2 is a circuit diagram illustrating an arrangement of an example of a switching circuit.

With reference to FIG. 2, an example of a switching circuit that can be used as the switching circuits ASW1, ASW2, . . . is described below. FIG. 2 is a circuit diagram illustrating an arrangement of an example of a switching circuit.

The switching circuit includes (i) an inverter circuit INV11, (ii) a CMOS switch including a pch transistor p11 and an nch transistor nil, and (iii) an nch transistor n12. In accordance with a control signal EN inputted from outside, when the control signal EN is High, the nch transistor n12 is closed, the pch transistor p11 and the nch transistor n11 of the CMOS switch are opened, and a signal CKIN inputted from outside is outputted as an output signal OUT. When the control signal EN becomes Low, the pch transistor p11 and the nch transistor n11 of the CMOS switch are closed, the nch transistor n12 is opened, and the output signal OUT is fixed to Low. The control signal EN is equivalent to the Q-output of the flip-flop SRFFk of FIG. 1. The input signal CKIN is equivalent to the clock signal SCK or SCKB of FIG. 1. The output signal OUT is equivalent to the output signals DSR1, SR1, SR2, . . . .

The Q-output of the flip-flop SRFFk is DQ1 if k=1, or Q1, Q2, . . . if k=2, 3, . . . , respectively. An output signal of the switching circuit ASW(k+1) becomes a reset signal for the flip-flop SRFFk. As a set signal for a first-stage flip-flop SRFF1, a start pulse SSP inputted from outside is inputted. The start pulse SSP also becomes an input signal to the NOR circuit NOR1. The output signal DQ1 of the flip-flop SRFF1 is inputted to the switching circuit ASW1, and the output signals Q1, Q2, . . . of the flip-flops SRFF2, SRFF3, . . . are respectively inputted to the switches V-ASW1, V-ASW2, . . . of the sampling section 31*b* through buffers Buf1, Buf2, . . . (described later) of the sampling section 31*b*. The output signals Q1, Q2, . . . become timing pulses for sampling video signals VIDEO (described later). For example, the output signals Q1, Q2, and Q3 are timing pulses for instructing the timing for sampling the video signals VIDEO to three adjacent data signal lines SL1 to SL3, respectively.

The sampling section (write circuit, precharge circuit) 31*b* includes buffers Buf1, Buf2, . . . , switches V-ASW1, V-ASW2, . . . , NOR circuits NOR1, NOR2, . . . (precharge control means), and a precharge circuit. The precharge circuit includes switches P-ASW1, P-ASW2, . . . . The buffers Buf1, Buf2, . . . and the switches V-ASW1, V-ASW2, . . . constitute a write circuit.

Each buffer Bufn (n=1, 2, . . . ) includes serially connected four inverters. The input of the buffer Bufn is the output signal Qn outputted from the shift register 31*a*, as described above. A switch (first switch) V-ASWn includes an analog switch and an inverter. The analog switch includes an N-channel MOS transistor (TFT) and a P-channel MOS transistor (TFT).

The N-channel MOS transistor receives an output signal of the buffer Bufn as an input signal, and the input signal is directly inputted to the gate (first control terminal) G of the N-channel MOS transistor. To the gate G of the P-channel MOS transistor, an inversion signal of the input signal is inputted. The inverter inverts the input signal, and inputs the inversion signal to the gate of the P-channel MOS transistor. The gate G of each MOS transistor is a capacitor-type control terminal, and the conductivity (conductive or nonconductive) of the switch V-ASWn is switched in accordance with the charge voltage of the gate. To one end of a channel path of an analog switch of each switch V-ASWn, an analog video signal (write signal) VIDEO is commonly inputted.

To each NOR circuit NORn (n=1, 2, . . . ), a simultaneous precharge instruction signal PCTL is commonly supplied from outside. The simultaneous precharge instruction signal PCTL is a second precharge control signal for making an instruction to the switches P-ASWn, which control precharge, so that precharge is performed by the simultaneous precharge method (so that the data signal lines SLn are precharged simultaneously).

The start pulse SSP is supplied to the NOR circuit NOR1, and the set signals DSR1, SR1, SR2, . . . for the flip-flops SRFF(k+1) are supplied to the other NOR circuits NORk (k=2, 3, 4, . . . ). The start pulse SSP and the set signals DSR1, SR1, SR2, . . . are first precharge control signals for making instructions so that, while video signals VIDEO are supplied to (while write signals are written onto) a part of the data signal lines, the rest of the data signal lines are precharged.

The NOR circuit NORn (n=1, 2, . . . ) outputs a control signal for controlling the switch P-ASWn to the switch P-ASWn. The NOR circuit NORn outputs a non-disjunction of the first precharge control signal (the start pulse SSP and the set signals DSR1, SR1, SR2, . . . ) and the second precharge control signal (simultaneous precharge instruction signal PCTL). Therefore, when at least one of the first precharge control signal and the second precharge control signal is High, the NOR circuit NORn outputs a Low-signal to the switch P-ASWn and thereby makes the switch P-ASWn conductive. Thus, when at least one of the first precharge control signal and the second precharge control signal instructs precharge, the NOR circuit NORn makes the switch P-ASWn conductive and thereby precharge the data signal line SLn.

As described above, a sequential precharge signal (first precharge signal; the start pulse SSP and the set signals DSR1, SR1, SR2, . . . ), which is generated by the shift register 31*a*, and the simultaneous precharge instruction signal PCTL (second precharge control signal), which is separately supplied from outside, are inputted to the NOR circuit NORn. This makes it possible to supply a desired potential (e.g. precharge potential) to the data signal line SLn when the sequential precharge signal or the simultaneous precharge instruction signal is inputted to the NOR circuit NORn.

As can be understood from the description above, the switch (second switch) P-ASWn includes an analog switch and an inverter. The analog switch includes an N-channel MOS transistor and a P-channel MOS transistor. The N-channel MOS transistor receives an output signal of the NOR circuit NORn as an input signal, and the input signal is directly inputted to the gate (second control terminal) G' of the N-channel MOS transistor. To the gate G' of the P-channel MOS transistor, an inversion signal of the input signal is inputted. The inverter inverts the input signal, and inputs the inversion signal to the gate G' of the N-channel MOS transistor. The gate G' of each MOS transistor is a capacitor-type control terminal, and the conductivity (conductive or nonconductive) of the switch P-ASWn is switched in accordance with the charge voltage of the gate. To one end of a channel path of an analog switch of each switch P-ASWn, a precharge potential PVID, which is applied from outside, is commonly inputted.

Another end of the channel path of the analog switch of each switch V-ASWn and another end of the channel path of the analog switch of each switch P-ASWn are connected to the data signal line (signal supply line) SLn (n=1, 2, . . . ) provided to the liquid crystal display panel. The liquid crystal display panel also has scanning signal lines GL1, GL2, . . . provided so as to be orthogonal to the data signal line SLn. At an intersection of the data signal line SLn and the scanning line GLm (m=1, 2, . . . ), a pixel Pixm_n (m=1, 2, . . . , n=1, 2, . . . ) is provided in matrix. In FIG. 1, only GL1 is shown among the scanning lines GLm, and only pixels Pix1_1 to Pix1_7 are shown among the pixels Pixm_n. Each pixel has an N-channel MOS transistor (TFT), a liquid crystal capacitor, and an auxiliary capacitor, as in an ordinary active matrix liquid crystal display device. A scanning signal line GLm is selected in a predetermined period. While being selected, the scanning signal line GLm makes the MOS transistor of the pixel connected to the scanning signal line GLm conductive.

Figure 3:
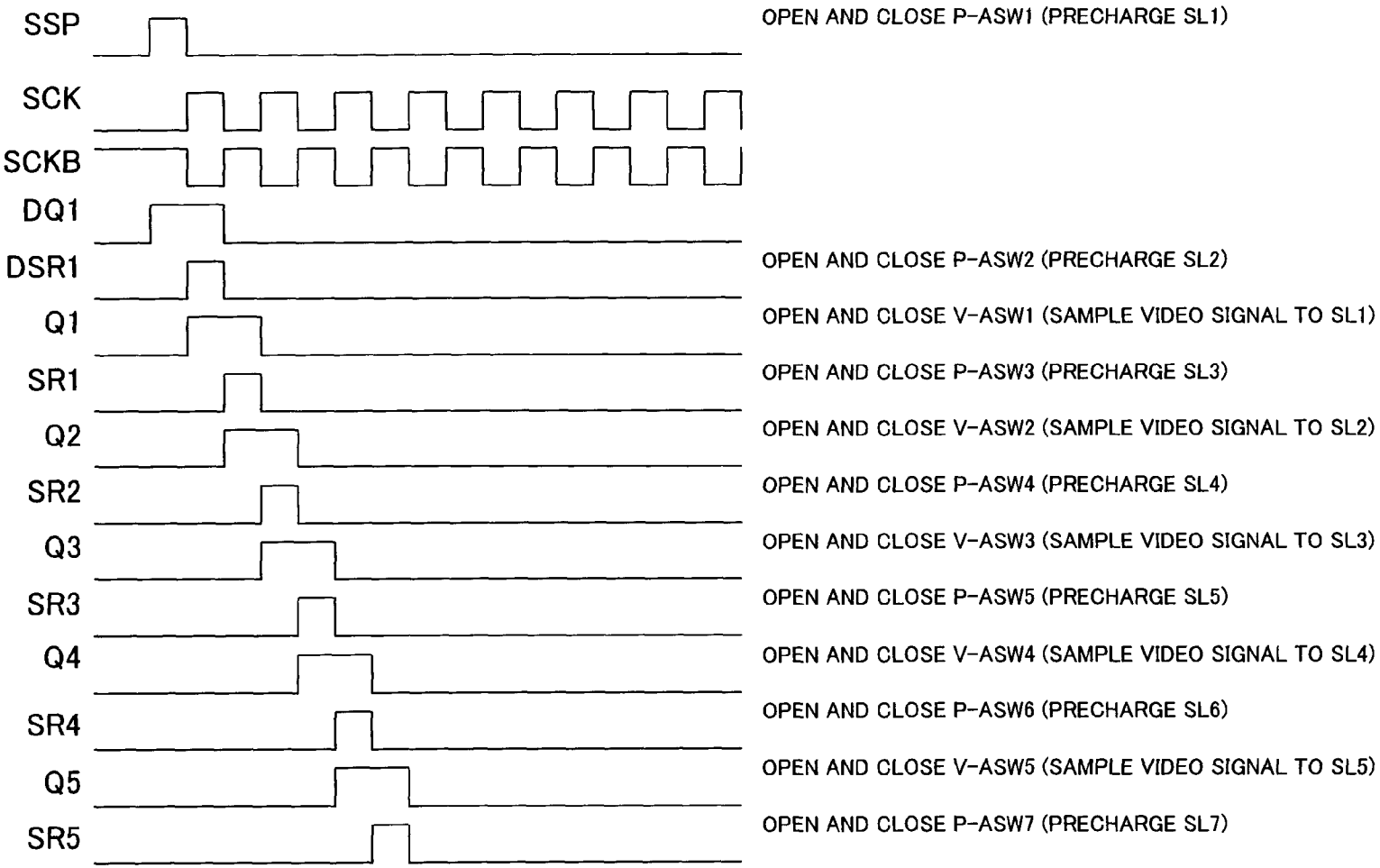
FIG. 3 is a timing chart illustrating signals associated with operation of the data signal line driver of FIG. 1.
Figure 4:
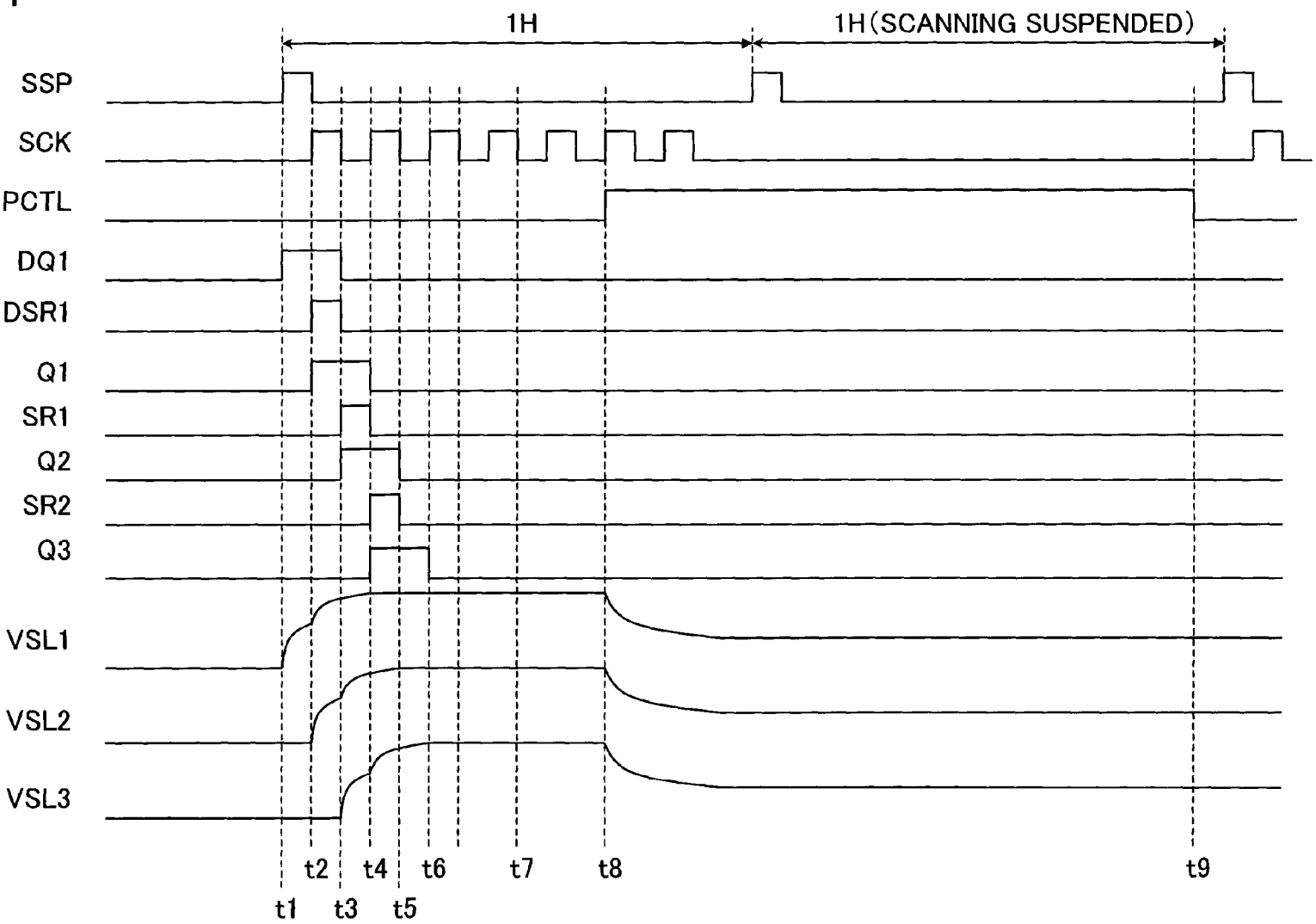
FIG. 4 is a figure relating to the data signal line driver of FIG. 1, illustrating a timing chart of each signal and potentials of source bus lines while scanning is suspended and while scanning is performed.

Next, operation of the data signal line driver having the foregoing arrangement is described, with reference to the timing charts of FIGS. 3 and 4. FIG. 3 illustrates a timing chart of each signal in a period in which video signals VIDEO are supplied from the data signal line driver 31 of the present embodiment to the data signal lines SLn (one period in which a scanning signal line GLm) is selected; hereinafter abbreviated as "1H"). FIG. 4 illustrates a timing chart of each signal and potentials of the data signal lines SLn in a period in which supply of the video signals VIDEO from the data signal line driver of the present embodiment to the data signal lines SLn is suspended ("1H (scanning suspended)") and in a period in which video signals are supplied to the data signal lines SLn ("1H"). In FIG. 4, the driving waveforms of three adjacent source bus lines SL1, SL2, and SL3 are illustrated. VSL1, VSL2, and VSL3 represent potentials of the data signal lines SL1 to SL3, respectively.

Discussed below is one period (1H) in which a scanning signal line GLm is selected. Since the scanning signal line GLm is selected, the data signal line SL and the pixel selected by being connected thereto are precharged. When the start pulse SSP is inputted, the output signal DQ1 is outputted from the flip-flop SRFF1, and the start pulse SSP is inputted to the NOR circuit NOR1. During a sampling effective period (described later), the simultaneous precharge instruction signal PCTL is Low. Therefore, an inversion signal of the start pulse SSP is inputted to the switch P-ASW1. When the start pulse SSP is inputted (when the start pulse SSP is High), the analog switch of the switch P-ASW1 becomes conductive (hereinafter expressed as "a switch becomes conductive or nonconductive"), and a precharge potential PVID is applied to the data signal line SL1. As a result, the data signal line SL1 and the capacitor of the selected pixel are precharged. Since the switch V-ASW1 is nonconductive at this time, the precharge potential PVID and the video signal VIDEO do not collide with each other on the data signal line SL1.

The switch circuit ASW1 becomes conductive by receiving the output signal DQ1. The switch circuit ASW1 then takes in the clock signal SCK and outputs the output signal DSR1. The output signal DSR1 becomes a set signal for the flip-flop SRFF2, and the flip-flop SRFF2 outputs the output signal Q1. By receiving the output signal Q1, the switch ASW2 becomes conductive. The switch ASW2 then takes in the clock signal SCKB, and outputs the output signal SR1. As a timing pulse, the output signal Q1 also makes the switch V-ASW1 conductive, through the buffer Buf1. As a result, the video signal VIDEO is supplied to the data signal line SL1, and the data signal line SL1 and the pixel capacitor are charged to a predetermined voltage. Thus, a sampling effective period from t1 to t7 (writing effective period) is started. In the sampling effective period from t1 to t7, which is within the predetermined period, video signals VIDEO are sampled in such a manner that the data signal lines sequentially fall in respective sampling periods.

At this time, since the start pulse SSP is already Low, the switch P-ASW1 is nonconductive. Therefore, the precharge potential PVID and the video signal VIDEO do not collide with each other. During the sampling effective period, since the simultaneous precharge instruction signal PCTL is Low, an inversion signal of the output signal DSR1 is inputted to the P-ASW2. Therefore, since the High output signal DSR1 makes the switch P-ASW2 conductive, the data signal line SL2 and the pixel electrode are precharged simultaneously when the video signal VIDEO is outputted to the data signal line SL1. On the other hand, since the output signal SR1 becomes a reset signal for the flip-flop SRFF1, the output signal DQ1 of SRFF1 becomes Low. As a result, the switch ASW1 becomes nonconductive.

Thus, in the sampling effective period from t1 to t7, operation of (i) supplying the video signal VIDEO to the data signal line SLn after the data signal line SLn is precharged, and (ii) precharging the data signal line SL(n+1) while the video signal VIDEO is supplied, is repeated. In this way, sampling is performed by the dot sequential method. This operation is analogous to operation of sequentially transmitting the timing pulse by the flip-flops SRFFk and the switches ASWk toward following flip-flops ASWk in the shift register. As shown in FIG. 3, a sampling period and a next sampling period overlap by half a period of the clock signals SCK and SCKB. In this case, the sampling potential is determined by the pixel capacitance and charge potential of the data signal line at the fall of the sampling pulse in each sampling period.

The sampling effective period is a period that continues until sampling to the last-stage data signal line SL is completed. In this period, the clock signals SCK and SCKB, which are inputted from a supply source that is different from the supply source of the timing pulse, are taken in and outputted by the switching circuit ASWk, and the control terminal (gate G') is charged. As a result, the switch P-ASWn (n=k+1) becomes conductive, thereby precharging those data signal lines that are not in the sampling periods. In the sampling effective period, such precharge is always performed. Therefore, the total number of the switching circuits ASWk is equal to the number of data signal lines SL precharged during the sampling effective period.

Thus, while a video signal VIDEO is sampled onto one data signal line SL, it is possible to precharge another data signal line SL. At this time, the timing pulse for sampling and the signal for performing precharge are supplied to different lines. Therefore, the control signal circuit of the switch V-ASW and the control signal circuit of the switch P-ASW are provided separately. In this way, it is possible to avoid the problem that, through the capacitor-type control terminal (gate G') of the switch P-ASW, a large current flowing on the data signal line SL at the time of precharge fluctuates the potential of the video signal VIDEO written onto the data signal line SL. Moreover, since each switching circuit ASWk, which takes in and outputs the clock signals SCK and SCKB, can be made more simply than flip-flops, the circuit size of the shift register 31*a* is much smaller than that of the conventional arrangement, in which the shift register is twice larger.

Thus, it is possible to provide a driver circuit of a display device, the driver circuit including a precharge circuit and, in precharging one signal supply line by a precharge power source having low driving capability, being capable of avoiding fluctuation of a signal supplied to another signal supply line, while having a small circuit size of the shift register.

On the other hand, in the period from t8 to t9 (period after the sampling effective period from t1 to t7), in which the supply of the video signal VIDEO to the data signal lines SL1, SL2, . . . is suspended, the simultaneous precharge instruction signal PCTL is High. Therefore, the switch P-ASWn always receives a High signal. Thus, in the period from t8 to t9, all data signal lines SL1, SL2, . . . are always precharged simultaneously.

In the foregoing manner, in the sampling effective period from t1 to t7, the data signal line driver 31 of the present embodiment sequentially precharges one of the data signal lines SLn that is not in the sampling periods, and, in the period from t8 and t9, which is not the sampling effective period, simultaneously precharges all the signal lines SLn. In this way, it is possible to precharge the data signal lines SLn sufficiently. Moreover, because only a small amount of charge is required as a supply to the data signal lines SLn while sampling to the data signal lines SLn is suspended, it is possible to precharge the data signal lines SLn even with a precharge power source having relatively low driving capability.

Figure 5:
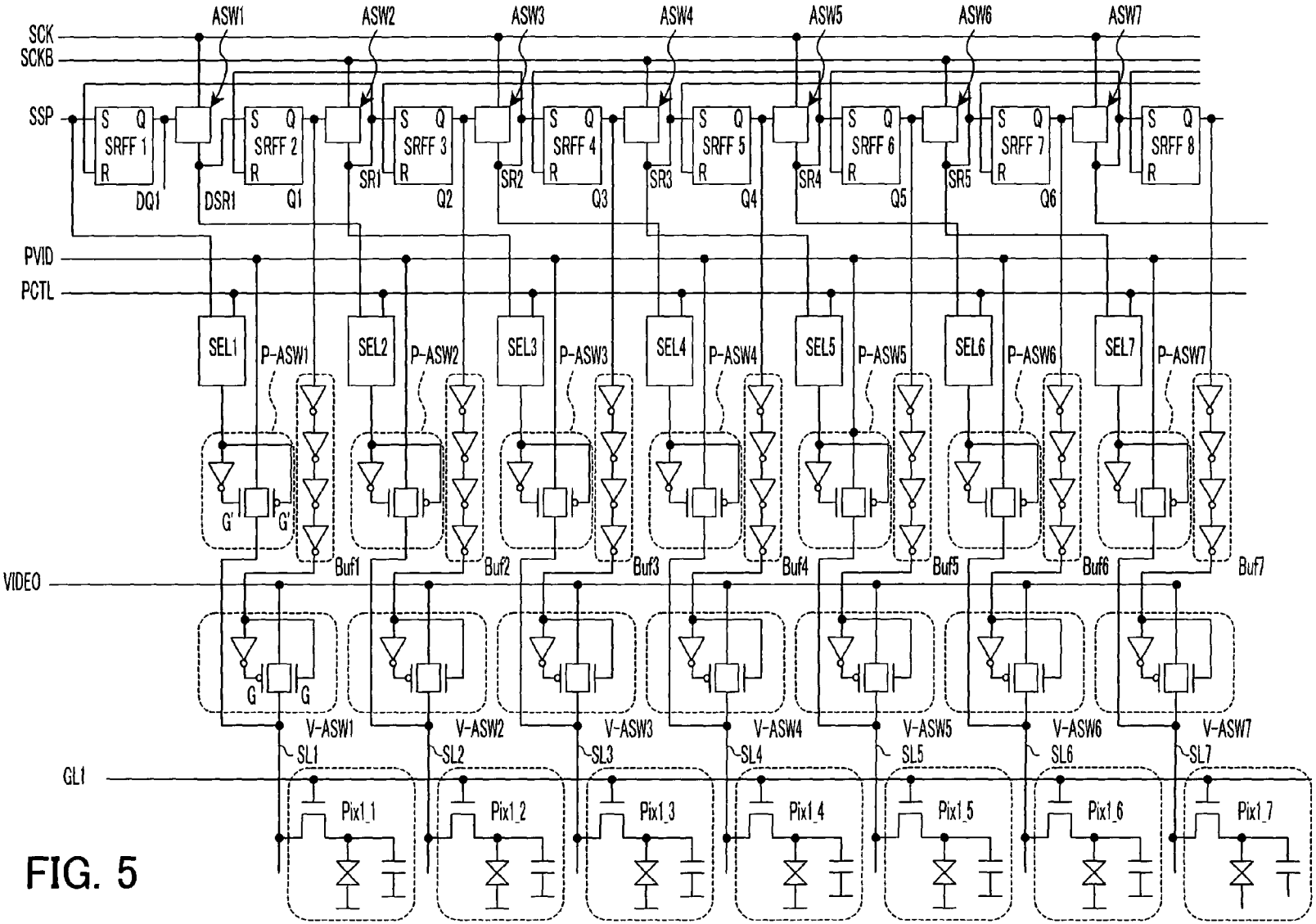
FIG. 5 is a circuit block diagram illustrating an arrangement of a variation example of the data signal line driver of FIG. 1.

In the data signal line driver 31 of the present embodiment, the NOR circuits NOR1, NOR2, NOR3, . . . are used. However, for the present invention, it is sufficient if there is provided means for controlling the precharge circuit so that data signal lines SLn are precharged while precharge is instructed by at least one of the first precharge control signal and the second precharge control signal. For example, as shown in FIG. 5, instead of the NOR circuits NOR1, NOR2, NOR3, . . . , there may be provided selector circuits SEL1, SEL2, SEL3, . . . (precharge control means; precharge control circuits) for selecting and outputting the first precharge control signal (the start pulse SSP and the set signals DSR1, SR1, SR2, . . . ) or the second precharge control signal (the simultaneous precharge instruction signal PCTL), and may be set so as to select the first precharge control signal in the sampling effective period and the second precharge control signal in a period other than the sampling effective period.

In order to use the selector circuits, it is necessary to control outputs of the selector circuits in accordance with whether it is in the sampling effective period or not. On the other hand, since such control is not required in the case of the NOR circuits, members related to the control (e.g. a control signal generating circuit and control signal supply lines) are not required. Therefore, it is more preferable to use the NOR circuits.

In the present embodiment, an entirely new idea not disclosed in Patent Publication 4 is introduced. That is, the clock signals are taken in as control signals for precharging the data signal lines, and inputted to the switches for applying precharge potentials to the data signal lines.

Embodiment 2

With reference to FIGS. 4 and 6 to 8, the following describes another embodiment of the present invention. Those members whose functions are identical to those of the members described in EMBODIMENT 1 are labeled with identical reference marks, and explanations of these members are omitted.

A driver circuit of a display device in accordance with the present embodiment is a data signal line driver of a liquid crystal display device. FIG. 3 illustrates an arrangement of a data signal line driver 32.

The data signal line driver 32 includes a shift register 32*a* and a sampling section (write circuit, precharge circuit) 32*b*.

The internal arrangement of the shift register 32*a* is identical to that of the shift register 31*a* of FIG. 1. However, destinations of the signals for precharge are different from those in the shift register 31*a* of FIG. 1. As a signal for precharge, the start pulse SSP, which is to be the set signal for the flip-flop SRFF1, is inputted to the NOR circuit NOR2. The output signal DSR1 is inputted to the NOR circuit NOR3. An output signal SR(k−1) (k=2, 3, . . . ) is outputted to a NOR circuit NORn (n=k+1).

Figure 6:
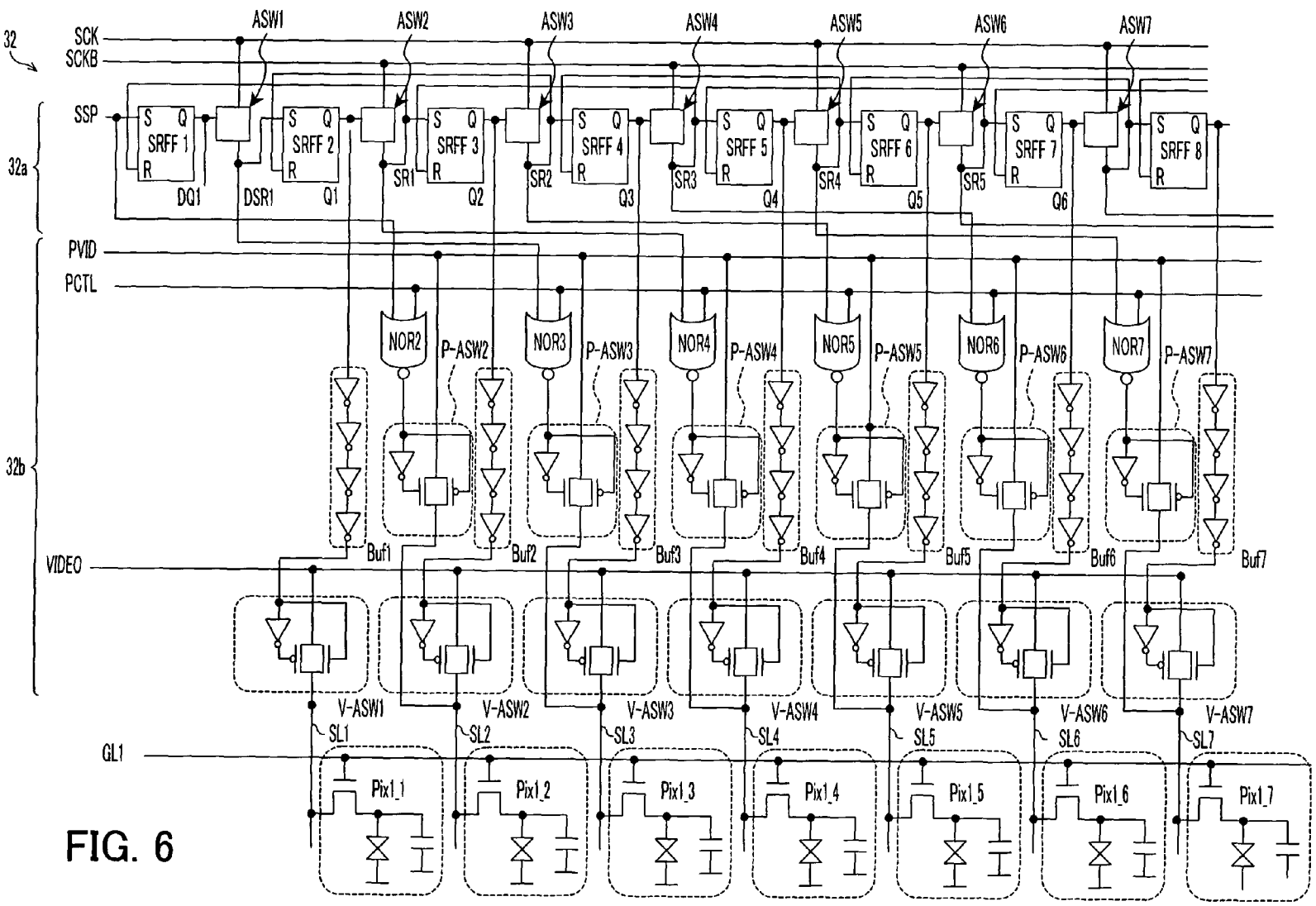
FIG. 6 is a circuit block diagram illustrating an arrangement of a data signal line driver of a second embodiment of the present invention.

Unlike the sampling section 31*b* of FIG. 1, the sampling section 32*b* does not include the NOR circuit NOR1 and the switch P-ASW1. The data signal line SL1 of FIG. 1 is replaced by a dummy signal line DSL. In FIG. 6, the data signal lines SL2, SL3, . . . of FIG. 1 are replaced by data signal lines SL1, SL2, . . . , respectively. The pixels connected to the data signal lines DSL are replaced by dummy pixels Pixm-D (m=1, 2, . . . ). Accordingly, the pixels connected to the data signal lines SL1, SL2, . . . are shifted in a horizontal direction. Thus, the data signal line driver 32 of the present embodiment is suitable as a driver circuit of a display device including dummy data signal lines and dummy pixels.

Figure 7:
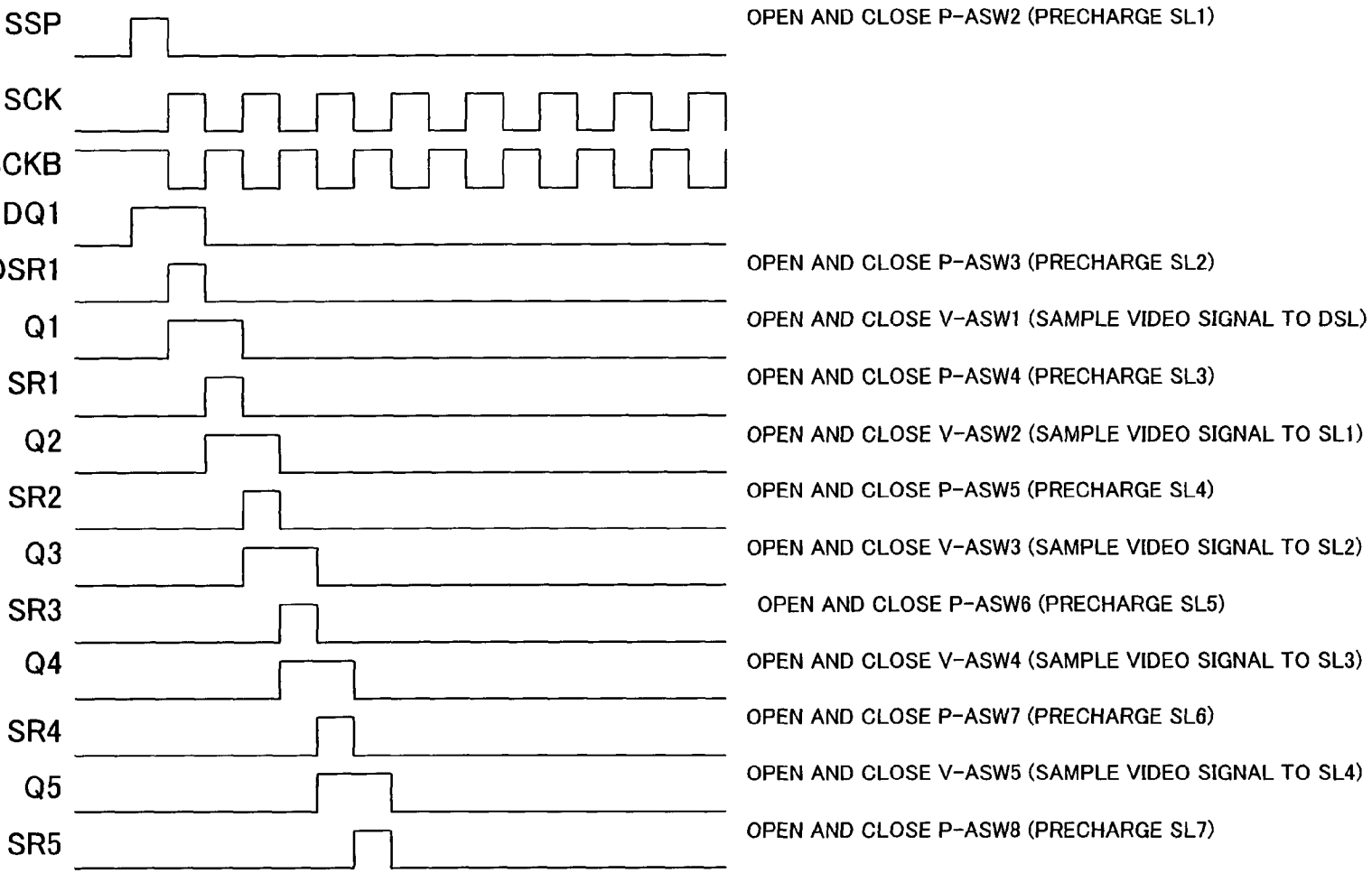
FIG. 7 is a timing chart illustrating signals associated with operation of the data signal line driver of FIG. 6.

FIG. 7 is a timing chart illustrating operation of the data signal line driver 32 having the foregoing arrangement. The principle of signal transmission is not described here in detail, because it is the same as that of FIG. 1. A feature of the present embodiment is that the completion of precharge and the start of sampling with respect to the same data signal line SL have a gap of half a period of the clock signals SCK and SCKB (for example, after the switch P-ASW2 is made conductive by the start pulse SSP and the data signal line SL1 is precharged, sampling to the data signal line SL1 is performed after half a period of the clock signals SCK and SCKB has elapsed).

In addition to the effect of EMBODIMENT 1, this arrangement has an effect that it is possible to make sure that the collision between the precharge potential PVID and the video signal VIDEO is avoided, and thereby attain high-quality display. Since the dummy pixels are usually provided under a light shielding material called black matrix, the dummy pixels do not appear on the screen. Therefore, it is not necessary to precharge the dummy pixels and the dummy signal lines.

In the data signal line driver 32 of the present embodiment, destinations of signals for precharge are different from those in the data signal line driver 31 of EMBODIMENT 1. Therefore, a timing chart of each signal and potentials of the data signal lines SLn while supply of the video signals VIDEO from the data signal line driver 32 of the present embodiment to the data signal lines SLn is suspended ("1H (scanning suspended)") and while video signals are supplied to the data signal lines SLn ("1H") would be different from FIG. 4, but omitted because they can be regarded as being essentially the same.

Figure 8:
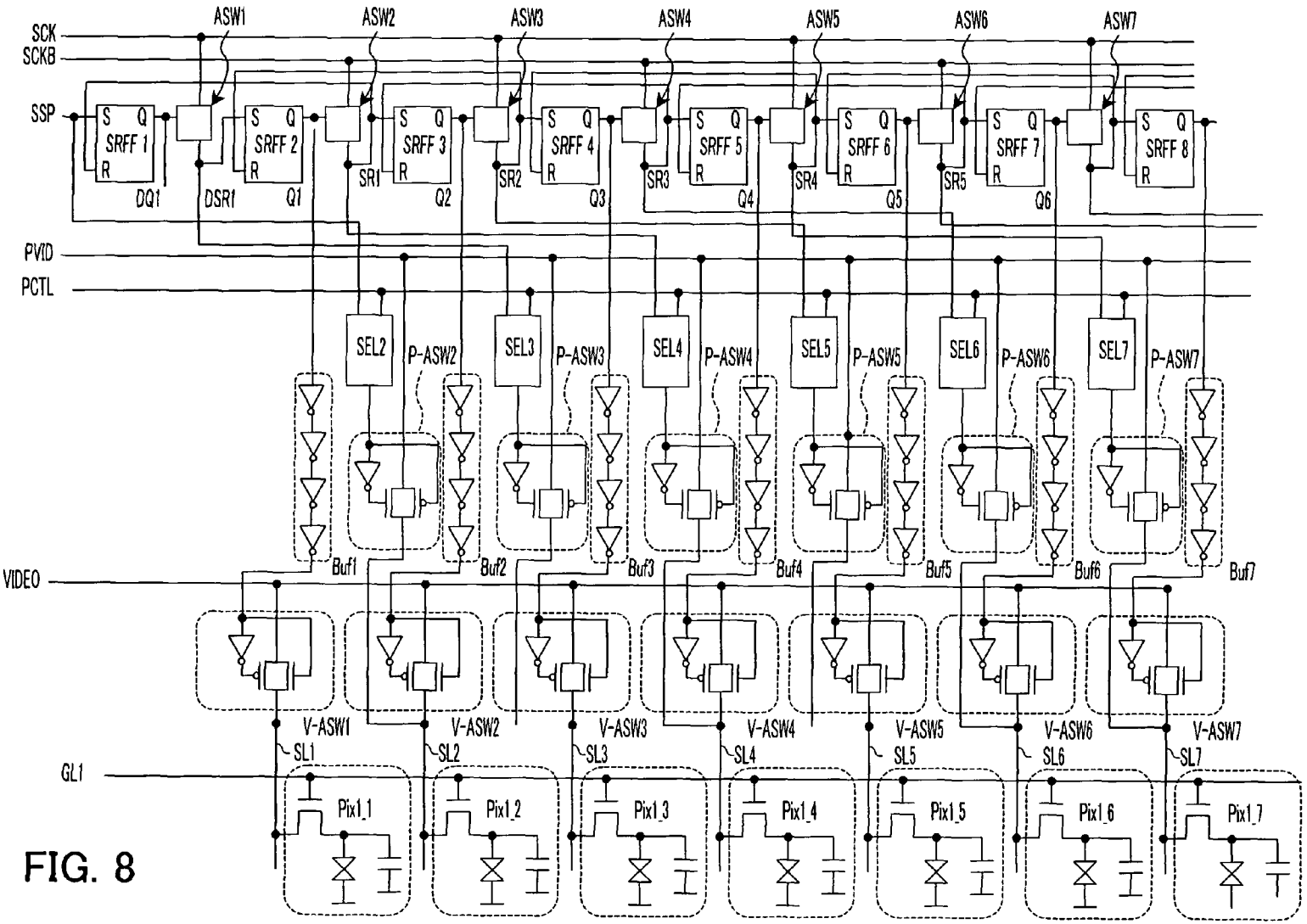
FIG. 8 is a circuit block diagram illustrating an arrangement of a variation example of the data signal line driver of FIG. 6.

In the data signal line driver 32 of the present embodiment, as shown in FIG. 8, instead of the NOR circuits NOR2, NOR3, . . . , there may be provided selector circuits SEL2, SEL3, . . . for selecting the first precharge control signal (the start pulse SSP and the set signals DSR1, SR1, SR2, . . . ) or the second precharge control signal (the simultaneous precharge instruction signal PCTL) and outputting it to the switch P-ASWn, and may be set so as to select the first precharge control signal in the sampling effective period and the second precharge control signal in a period other than the sampling effective period.

Embodiment 3

With reference to FIGS. 4 and 9 to 14, the following describes yet another embodiment of the present invention. Those members whose functions are identical to those of the members described in EMBODIMENT 1 or 2 are labeled with identical reference marks, and explanations of these members are omitted.

Figure 9:
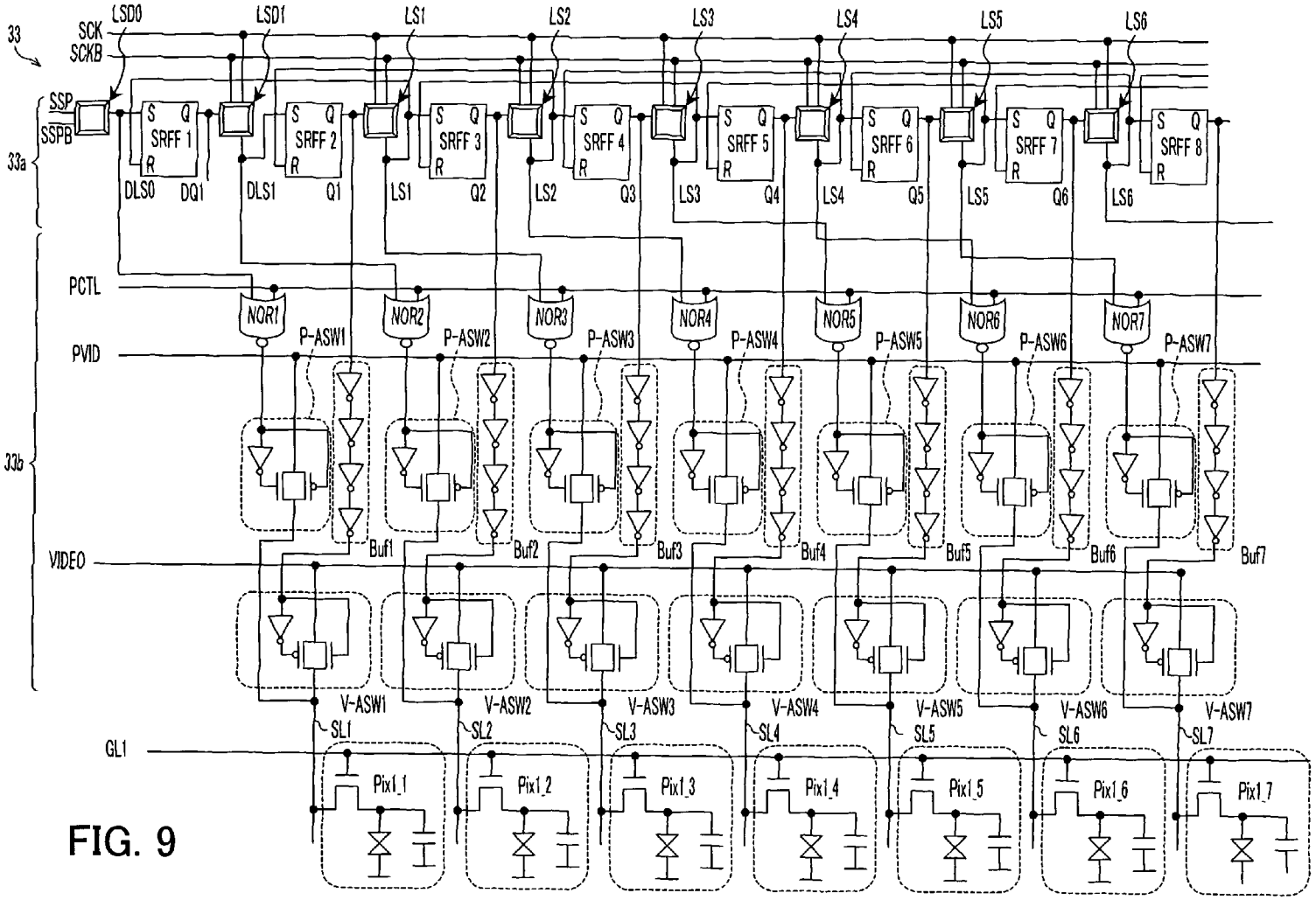
FIG. 9 is a circuit block diagram illustrating an arrangement of a data signal line driver of a third embodiment of the present invention.

A driver circuit of a display device in accordance with the present embodiment is a data signal line driver of a liquid crystal display device. FIG. 9 illustrates an arrangement of a data signal line driver 33.

The data signal line driver 33 includes a shift register 33*a* and a sampling section (write circuit, precharge circuit) 33*b*.

The shift register 33*a* includes the flip-flops SRFFk (k=1, 2, . . . ) of FIG. 1 and level shift circuits LSD0, LSD1, LS1, LS2, . . . . The level shift circuits LSD1, LS1, LS2, . . . replace the switching circuits ASW1, ASW2, ASW3, . . . of FIG. 1, respectively. The level shift circuits LSD1, LS1, LS2, . . . have the same arrangement. When a High Q-output of a flip-flop is inputted, each of the level shift circuits LSD1, LS1, LS2, . . . takes in the clock signals SCK and SCKB, and performs level shift by using the clock signals SCK and SCKB. The level shift circuits LSD1, LS2, LS4, . . . perform level shift of the waveform of the clock signal SCK, and the level shift circuits LSD0, LS1, LS3, . . . perform level shift of the waveform of the clock signal SCKB. As a result of level shift, the level shift circuits LSD1, LS1, LS2, . . . output, respectively, output signals DLS1, LS1, LS2, . . . (precharge control signals). These output signals become set signals for respective next-stage flip-flops.

The level shift circuit LSD0 is a level shift circuit to which start pulses SSP and SSPB are inputted so as to perform level shift of the start pulse SSP inputted to a first-stage flip-flop. The start pulse SSPB is an inversion signal of the start pulse SSP. The level shift circuit LSD0 performs level shift of the start pulse SSP, and outputs it as an output signal DLS0.

Thus, the data signal line driver 33 of the present embodiment is suitable for a driver circuit of a display device if voltage level of such signals as the clock signals SCK, SCKB and the start pulse signal SSP, which are inputted from outside, is low.

The internal arrangement of the sampling section 33*b* is identical to that of the sampling section 31*b* of FIG. 1. Output signals DLS0, DLS1, LS1, LS2, . . . of the shift register 33*a* become input signals to the NOR circuits NOR1, NOR2, NOR3, NOR4, . . . , respectively.

The data signal lines SLn (n=1, 2, . . . ), scanning signal lines SLm (m=1, 2, . . . ), and pixels Pixm-n (m=1, 2, . . . , n=1, 2, . . . ) are identical to those of FIG. 1.

Figure 10:
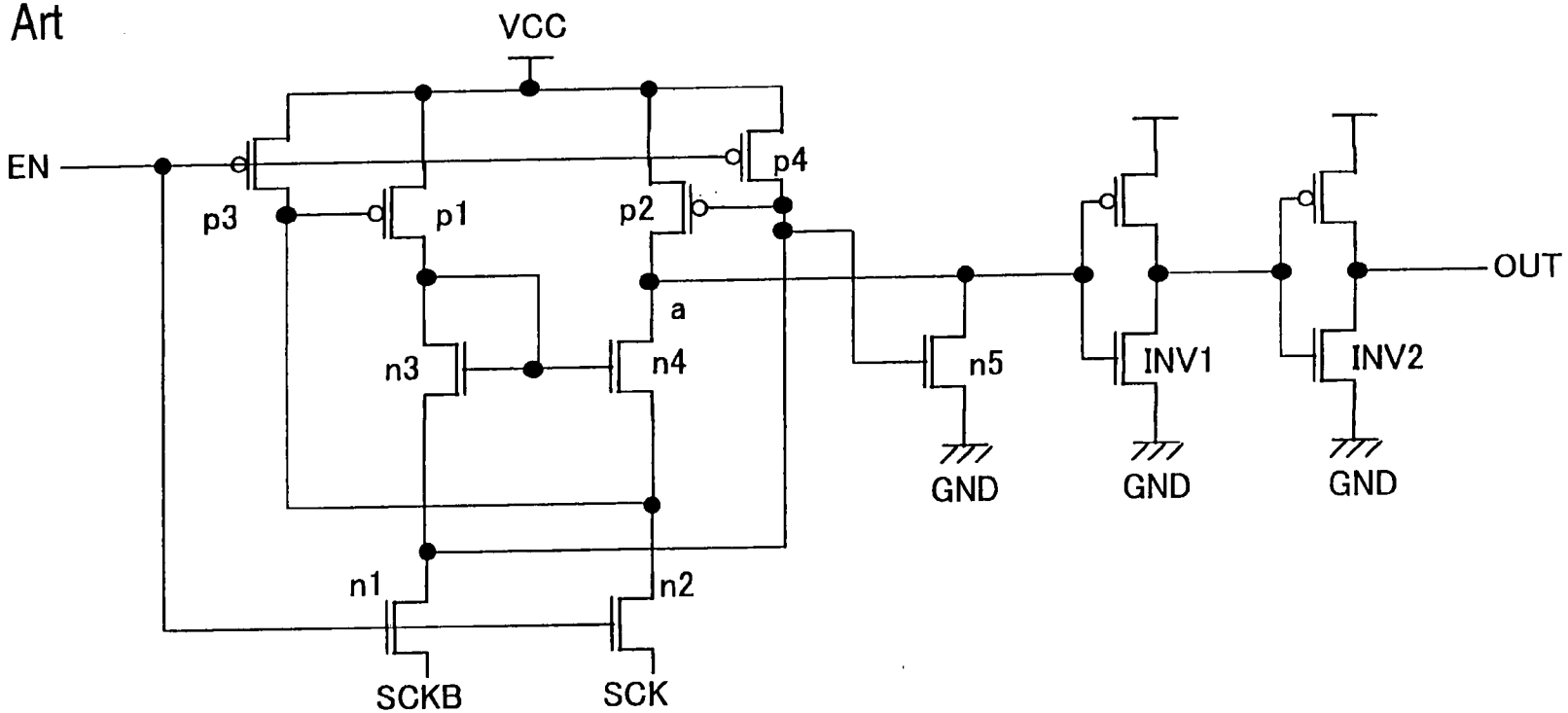
FIG. 10 Prior Art
FIG. 10 is a circuit diagram illustrating an arrangement of an example of the level shift circuit.

With reference to FIG. 10, the following describes an example of a level shift circuit that can be used as the level shift circuits LSD0, LSD1, LS1, LS2, . . . . FIG. 10 is a circuit diagram illustrating an arrangement of an example of a level shift circuit.

A level shift circuit takes in the clock signals SCK and SCKB from outside when the control signal EN, which is inputted from outside, becomes High, and outputs a level shift signal of the clock signal SCK as an output signal OUT. The control signal EN is equivalent to the Q-output of a flip-flop in FIG. 9. The output signal OUT corresponds to the output signals DLS1, LS1, LS2, . . . of FIG. 9.

However, if the level shift circuit is the level shift circuit LSD0, the level shift circuit takes in the start pulses SSP and SSPB, instead of the clock signals SCK and SCKB, and outputs a level shift signal of the clock signal SSP as an output signal OUT.

The operation of the level shift circuit of FIG. 10 is controlled by the control signal EN. The level shift circuit of FIG. 10 starts operating when the control signal EN is High. When the control signal EN is Low, the level shift circuit always output a Low signal as an output signal OUT.

Figure 11:
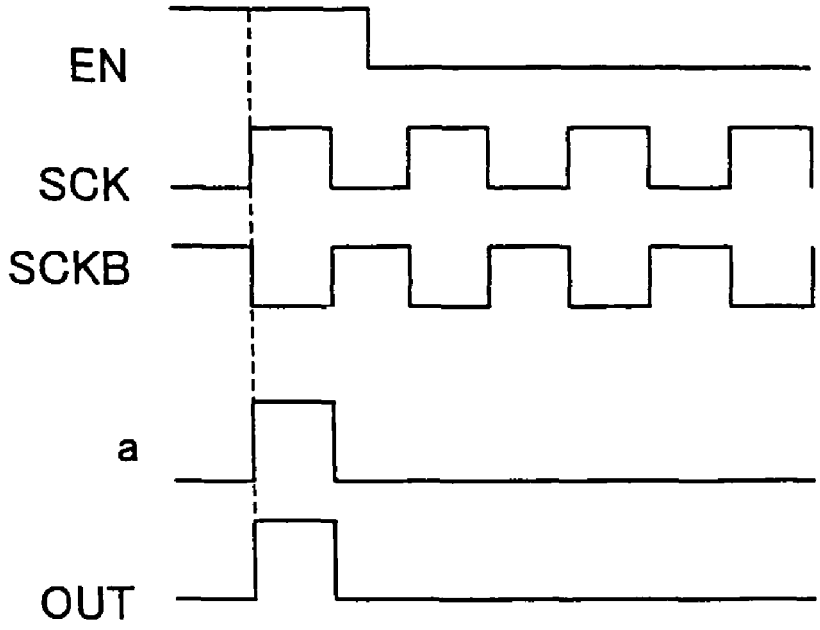
FIG. 11 Prior Art
FIG. 11 is a timing chart illustrating waveforms of input signals, a node signal, and an output signal of the level shift circuit.

With reference to the marks of FIG. 10 and the timing chart of FIG. 11, the following describes the operation of the level shift circuit. FIG. 11 is a timing chart illustrating waveforms of an input signal, a node signal, and an output signal of the level shift circuit.

As shown in the timing chart of FIG. 11, if the clock signal CK becomes High while the control signal EN is High, pch transistors p3 and p4 are closed and nch transistors n1 and n2 are opened, in accordance with the control signal EN. At this time, through pch transistors p1 and p2 and nch transistors n3 and n4, while the clock signal CK is High, a High signal is inputted to a node "a" through a pch transistor p2, and the node "a" becomes High. Then, when the clock signal CK becomes Low, a Low signal is inputted to the node "a" through an nch transistor n4, and the node "a" becomes Low. The state (High or Low) of the node "a" is transmitted to an output terminal of the level shift circuit through inverter circuits INV1 and INV2, and outputted as an output signal OUT. This signal appears on the output terminal as a level shift signal of the clock signal CK.

Next, when the control signal EN becomes Low, the pch transistors p3 and p4 are opened, and the nch transistors n1 and n2 are closed. At this time, a power supply voltage VCC is supplied from a power source VCC to the gates of the pch transistors p1 and p2, through the pch transistors p3 and p4. As a result, the pch transistors p1 and p2 are closed, and the path of the current flowing from the power source VCC disappears. To the gate of the nch transistor n3, as well as to the gates of the pch transistors p1 and p2, the power source voltage VCC is supplied. Therefore, the nch transistor n3 is opened, and the node "a" becomes Low. As a result, the output signal OUT of the level shift circuit becomes Low. Thus, even if the clock signal CK is inputted with an amplitude of potential smaller than the power source voltage VCC, the output signal OUT of the level shift circuit is Low. If the control signal EN is low, the path of the current flowing from the power source VCC disappears. Therefore, it is possible to reduce unnecessary power consumption.

Figure 12:
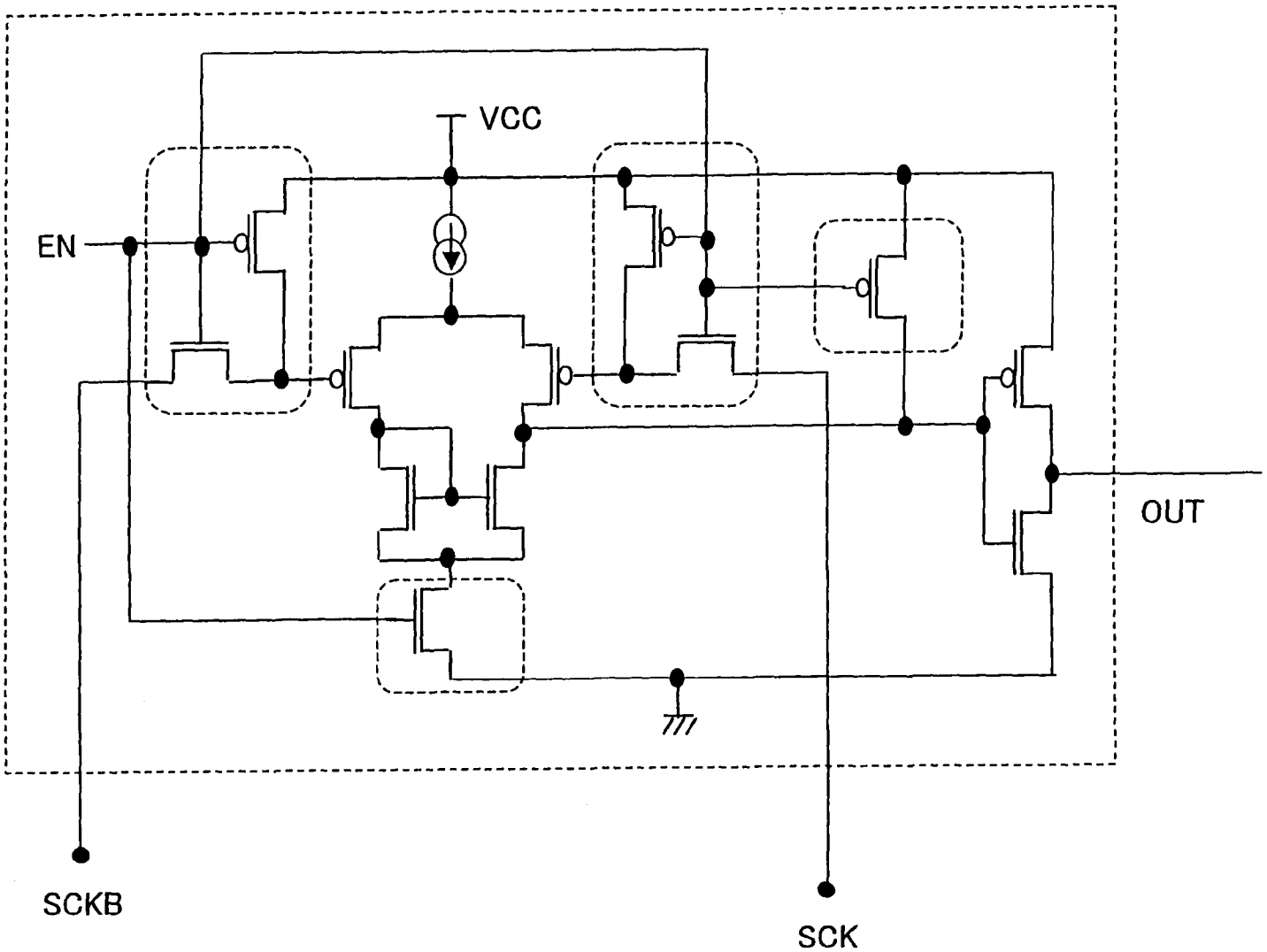
FIG. 12 Prior Art
FIG. 12 is a circuit diagram illustrating an arrangement of another example of the level shift circuit.

Although operation is not described here, the effect of the level shift circuit of FIG. 10 can be attained also by a level shift circuit having an arrangement of FIG. 12. FIG. 12 is a circuit diagram illustrating an arrangement of another example of the level shift circuit.

Figure 13:
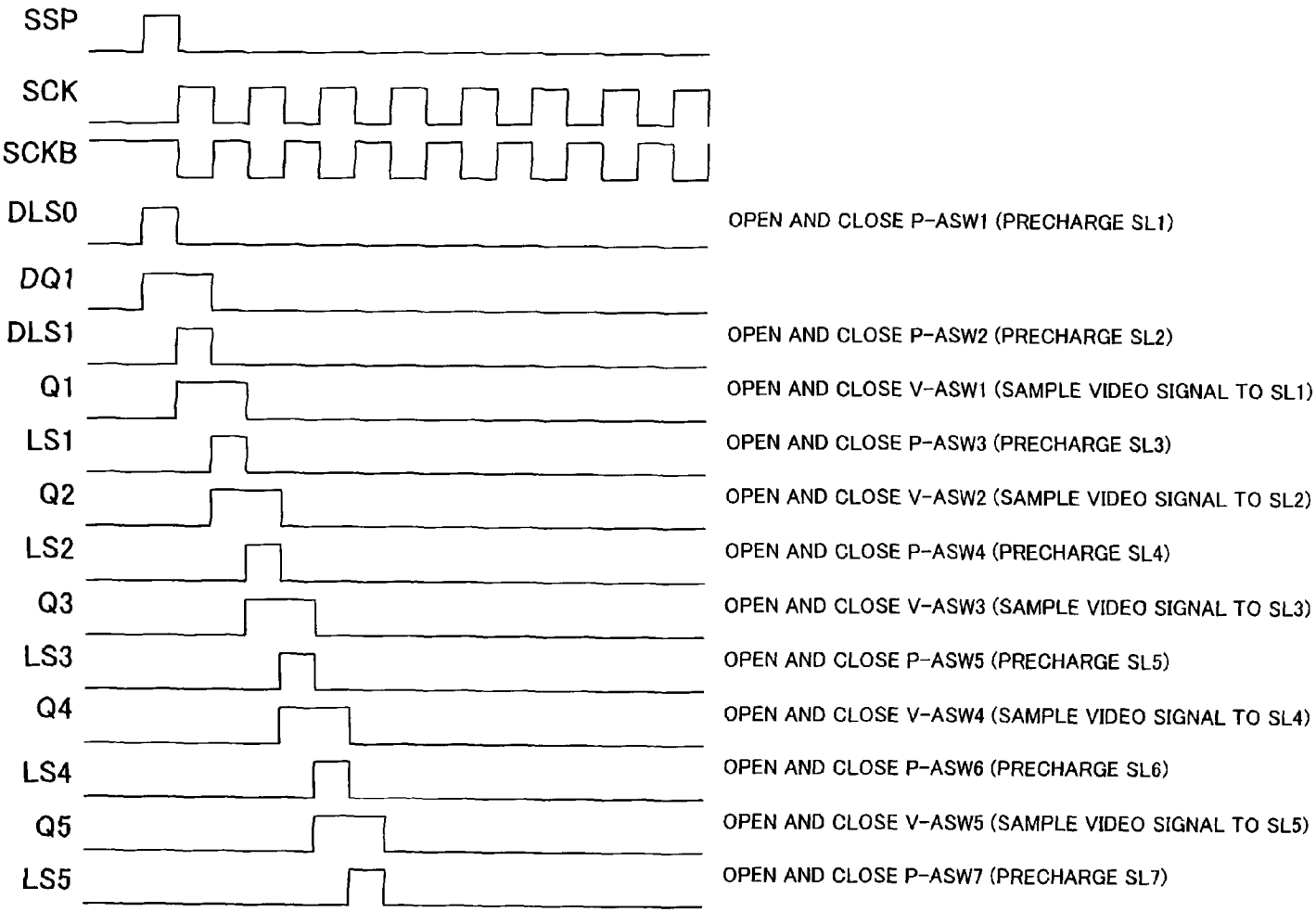
FIG. 13 is a timing chart illustrating signals associated with operation of the data signal line driver of FIG. 9.

Next, with reference to the timing chart of FIG. 13, the following describes operation of the data signal line driver 33 having the foregoing arrangement.

Discussed below is one period in which a scanning signal line GLm is selected. Since the scanning signal line GLm is selected, the data signal line SL and the pixel selected by being connected thereto are precharged. When the start pulses SSP and SSPB are inputted, the level shift circuit LSD0 performs level shift of the start pulses SSP and SSPB, and outputs the output signal DLS0. Then, the output signal DQ1 is outputted from the flip-flop SRFF1, and the start pulse SSP is inputted to the NOR circuit NOR 1. During a sampling effective period (described later), the simultaneous precharge instruction signal PCTL is Low. Therefore, an inversion signal of the start pulse SSP is inputted to the switch P-ASW1. When the start pulse SSP is inputted (when the start pulse SSP is High), the switch P-ASW1 becomes conductive, and a precharge potential PVID is applied to the data signal line SL1. As a result, the data signal line SL1 and the capacitor of the selected pixel are precharged. Since the switch V-ASW1 is nonconductive at this time, the precharge potential PVID and the video signal VIDEO do not collide with each other on the data signal line SL1.

When the output signal DQ1 is inputted, the level shift circuit LSD1 takes in the clock signals SK and SCKB, performs level shift of the clock signal SCK, and outputs the output signal DLS1. The output signal DLS1 becomes a set signal for the flip-flop SRFF2, and the flip-flop SRFF2 outputs the output signal Q1. When the output signal Q1 is inputted, the level shift circuit LS1 takes in the clock signals SCKB and SCK, performs level shift of the clock signal SCKB, and outputs the output signal LS1. As a timing pulse, the output signal Q1 makes the switch V-ASW1 conductive through the buffer Buf1. As a result, the video signal VIDEO is supplied to the data signal line SL1, and the data signal line SL1 and the pixel electrode are charged to a predetermined voltage. Thus, a sampling effective period (writing effective period) is started. In the sampling effective period, which is within the predetermined period, video signals VIDEO are sampled in such a manner that the data signal lines sequentially fall in respective sampling periods.

At this time, since the start pulse SSP and the output signal DLS0 are already Low, the switch P-ASW1 is nonconductive. Therefore, the precharge potential PVID and the video signal VIDEO do not collide with each other on the data signal line SL1. Moreover, since the output signal DLS1 makes the switch P-ASW1 conductive, the data signal line SL2 and the pixel electrode are precharged simultaneously when the video signal VIDEO is outputted to the data signal line SL1. On the other hand, since the output signal LS1 becomes a reset signal for the flip-flop SRFF1, the output signal DQ1 of SRFF1 becomes Low. As a result, the level shift circuit LSD1 suspends its level shift operation.

If the flip-flops used in the shift register are D-flip-flops serially connected with each other, it is necessary to use both the input signal and output signal of each stage of the D-flip-flops, in order to control execution and suspension of the operation of the level shift circuit. On the other hand, since the shift register 33*a* of the present embodiment uses set-reset flip-flops, only the output signal of a preceding-stage flip-flop is required, in order to control execution and suspension of the operation of the level shift circuit. As a result, the arrangement of the shift register can be simplified.

Thus, operation of (i) supplying the video signal VIDEO to the data signal line SLn after the data signal line SLn is precharged, and (ii) precharging the data signal line SL(n+1) while the video signal VIDEO is supplied, is repeated. In this way, sampling is performed by the dot sequential method. This operation is analogous to operation of sequentially transmitting the timing pulse by the flip-flops SRFFk and the level shift circuits toward following stages in the shift register. As shown in FIG. 13, a sampling period and a next sampling period overlap by half a period of the clock signals SCK and SCKB. In this case, the sampling potential is determined by the pixel capacitance and charge potential of the data signal line SL at the fall of the sampling pulse in each sampling period.

The sampling effective periods is a period that continue until sampling on the last-stage data signal line SL is completed. In this period, the clock signals SCK and SCKB, which are inputted from a supply source that is different from the supply source of the timing pulse, are taken in and outputted by the level shift circuits LSD1, LS1, LS2, . . . , and the control terminal (gate G') is charged. As a result, the switch P-ASWn becomes conductive, thereby precharging those data signal lines SL that are not in the sampling periods. In the sampling effective period, such precharge is always performed. For this purpose, the total number of the level shift circuits LSD1, LS1, LS2, . . . is equal to the number of data signal lines SL precharged during the sampling effective period. In order to perform precharge in a period other than the sampling effective period (e.g. precharge of the data signal line SL1), it is not always necessary to provide the level shift circuits.

Thus, while a video signal VIDEO is sampled onto one data signal line SL, it is possible to precharge another data signal line SL. At this time, the timing pulse for sampling and the signal for performing precharge are supplied to different lines. Therefore, the control signal circuit of the switch V-ASW and the control signal circuit of the switch P-ASW are provided separately. In this way, it is possible to avoid the problem that, through the capacitor-type control terminal (gate G') of the switch P-ASW, a large current flowing on the data signal line SL at the time of precharge fluctuates the potential of the video signal VIDEO written onto the data signal line SL. Moreover, since the level shift circuits LSD1, LS1, LS2, . . . , each of which takes in the clock signals SCK and SCKB, performs level shift, and outputs an output signal, and the level shift circuit LSD0 can be made more simply than flip-flops, the circuit size of the shift register 33*a* is much smaller than that of the conventional arrangement, in which the shift register is twice larger.

Thus, it is possible to provide a driver circuit of a display device, the driver circuit including a precharge circuit and, in precharging one signal supply line by a precharge power source having low driving capability, being capable of avoiding fluctuation of a signal supplied to another signal supply line, while having a small circuit size of the shift register.

As can be seen from the fact that the clock signals inputted to the level shift circuits may be low-voltage signals, the level shift circuits have a function of low-voltage interface. Therefore, it is possible to reduce power consumption of the external circuit that generates the clock signals.

A timing chart of each signal and potentials of the data signal lines SLn while supply of the video signals VIDEO from the data signal line driver 33 of the present embodiment to the data signal lines SLn is suspended ("1H (scanning suspended)") and while video signals are supplied to the data signal lines SLn ("1H") would be different from those of the data signal line driver 31 of EMBODIMENT 1 shown in FIG. 4, but omitted because they can be regarded as being essentially the same.

Figure 14:
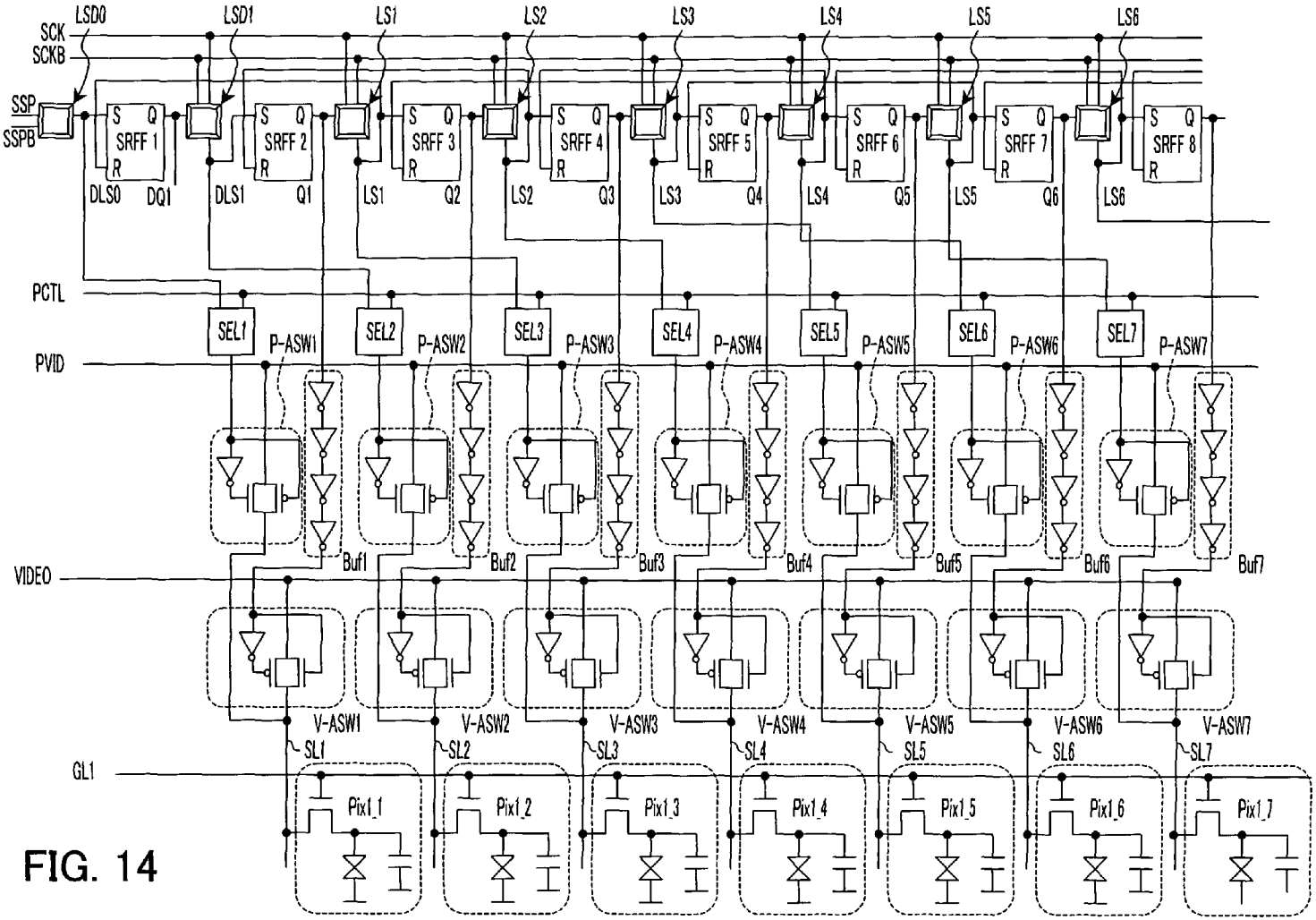
FIG. 14 is a circuit block diagram illustrating an arrangement of a variation example of the data signal line driver of FIG. 9.

In the data signal line driver 33 of the present embodiment, as shown in FIG. 14, instead of the NOR circuits NOR1, NOR2, NOR3, . . . , there may be provided selector circuits SEL1, SEL2, SEL3, . . . for selecting the first precharge control signal (the signals DLS0, DLS1, LS1, LS2, . . . ) or the second precharge control signal (the simultaneous precharge instruction signal PCTL) and outputting it to the switches ASWn, and may be set so as to select the first precharge control signal in the sampling effective period and the second precharge control signal in a period other than the sampling effective period.

In the present embodiment, an entirely new idea not disclosed in Patent Publication 5 and 6 is introduced. That is, a control signal for precharging a data signal line is generated by performing level shift of a clock signal, and inputted to a switch for applying a precharge potential to the data signal line.

Embodiment 4

Figure 15:
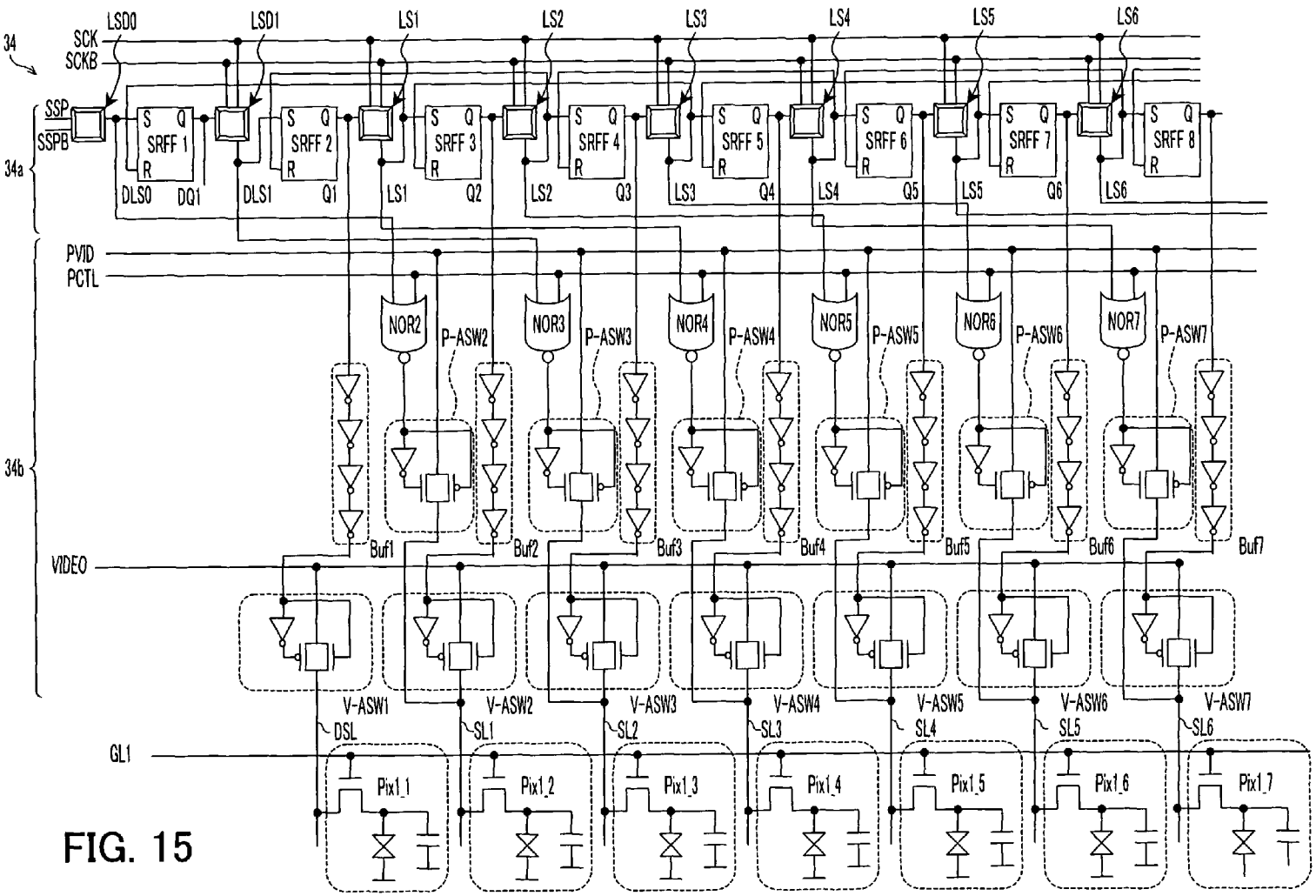
FIG. 15 is a circuit block diagram illustrating an arrangement of a data signal line driver of a fourth embodiment of the present invention.
Figure 16:
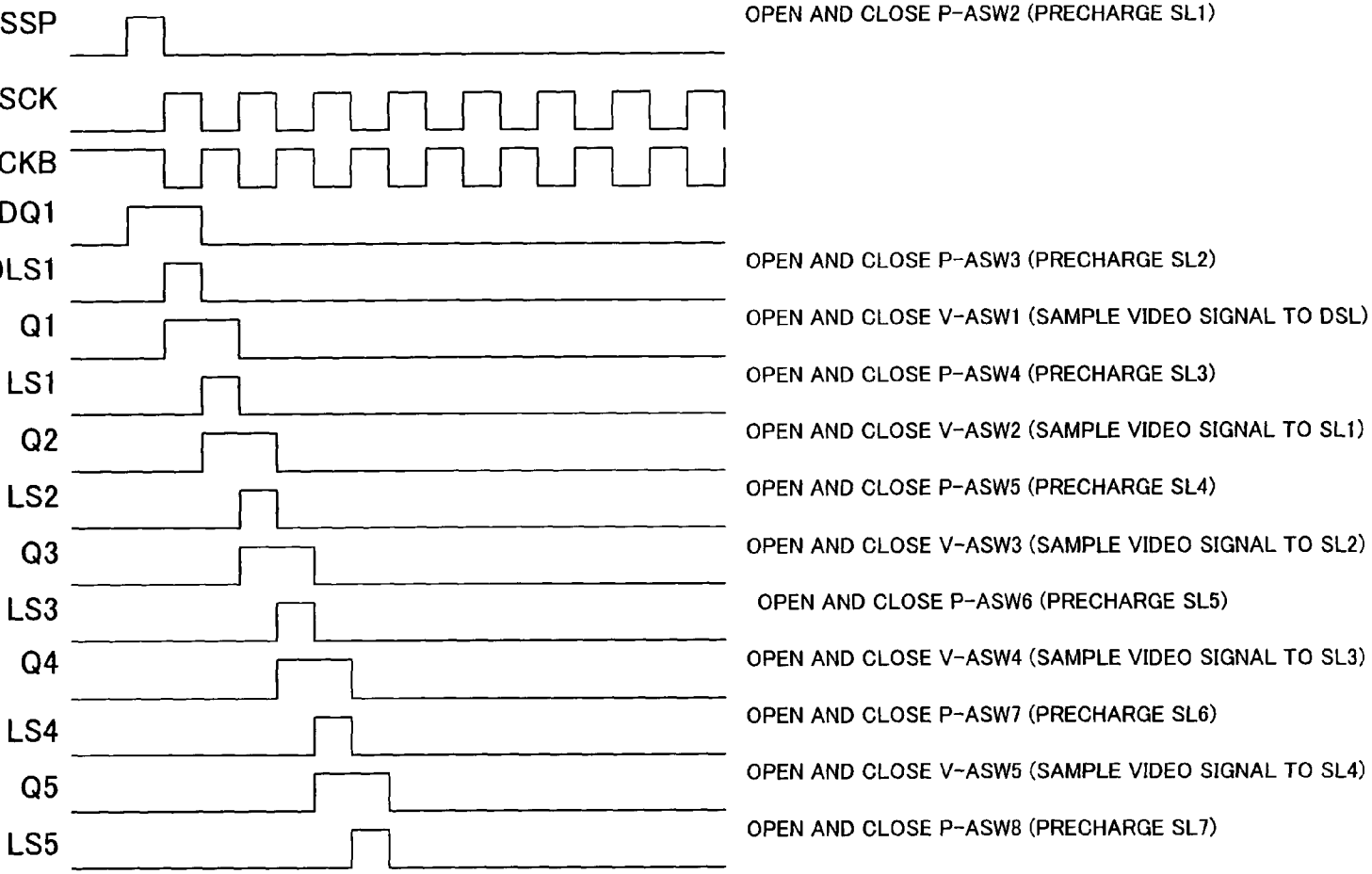
FIG. 16 is a timing chart illustrating signals associated with operation of the data signal line driver of FIG. 15.
Figure 17:
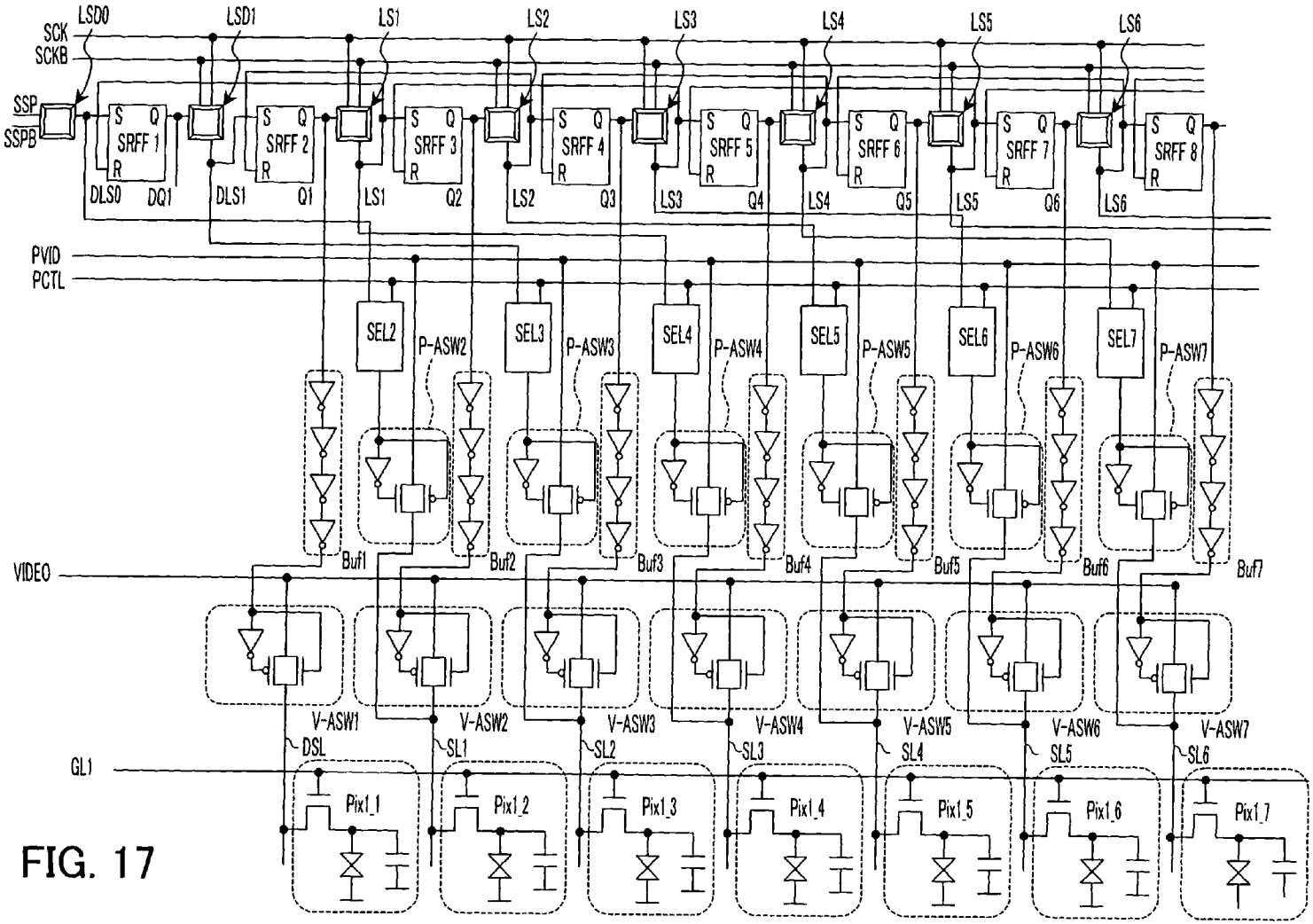
FIG. 17 is a circuit block diagram illustrating an arrangement of a variation example of the data signal line driver of FIG. 15.

With reference to FIGS. 15 to 17, the following describes still another embodiment of the present invention. Those members whose functions are identical to those of the members described in EMBODIMENT 1 to 3 are labeled with identical reference marks, and explanations of these members are omitted.

The data signal line driver 34 includes a shift register 34*a* and a sampling section (write circuit, precharge circuit) 34*b*.

The internal arrangement of the shift register 34*a* is identical to that of the shift register 33*a* of FIG. 9. However, destinations of the signals for precharge are different from those in the shift register 33*a* of FIG. 9. As a signal for precharge, the output signal DLS0, which is to be the set signal for the flip-flop SRFF1, is inputted to the switch P-ASW2. The output signal DLS1 is inputted to the switch P-ASW3. The output signals LS1, LS2, . . . are inputted to the switches P-ASW4, P-ASW5, . . . . .

Unlike the sampling section 33*b* of FIG. 9, the sampling section 34*b* does not include the switch P-ASW1. The data signal line SL1 of FIG. 9 is replaced by a dummy signal line DSL. In FIG. 15, the data signal lines SL2, SL3, . . . of FIG. 9 are replaced by data signal lines SL1, SL2, respectively. The pixels connected to the data signal line DSL are replaced by dummy pixels Pixm-D (m=1, 2, . . . ). Accordingly, the pixels connected to the data signal lines SL1, SL2, . . . are shifted in a horizontal direction. Thus, the data signal line driver of the present embodiment is suitable as a driver circuit of a display device including dummy data signal lines and dummy pixels.

FIG. 16 is a timing chart illustrating operation of the data signal line driver 34 having the foregoing arrangement. The principle of signal transmission is not described here in detail, because it is the same as that of FIG. 9. A feature of the present embodiment is that the completion of precharge and the start of sampling with respect to the same data signal line SL have a gap of half a period of the clock signals SCK and SCKB (for example, after the switch P-ASW2 is made conductive by the start pulse SSP (hence the output signal DL0) and the data signal line SL1 is precharged, sampling to the data signal line SL1 is performed after half a period of the clock signals SCK and SCKB has elapsed).

In addition to the effect of EMBODIMENT 3, this arrangement has an effect that it is possible to make sure that the collision between the precharge potential PVID and the video signal VIDEO is avoided, and thereby attain high-quality display. Since the dummy pixels are usually provided under a light shielding material called black matrix, the dummy pixels do not appear on the screen. Therefore, it is not necessary to precharge the dummy pixels and the dummy signal lines.

A timing chart of each signal and potentials of the data signal lines SLn while supply of the video signals VIDEO from the data signal line driver 34 of the present embodiment to the data signal lines SLn is suspended ("1H (scanning suspended)") and while video signals are supplied to the data signal lines SLn ("1H") would be different from those of the data signal line driver 31 of EMBODIMENT 1 shown in FIG. 4, but omitted because they can be regarded as being essentially the same.

In the data signal line driver 34 of the present embodiment, as shown in FIG. 17, instead of the NOR circuits NOR2, NOR3, . . . , there may be provided selector circuits SEL2, SEL3, . . . for selecting the first precharge control signal (the signals DLS1, LS1, LS2, . . . ) or the second precharge control signal (the simultaneous precharge instruction signal PCTL) and outputting it to the switches P-ASWn, and may be set so as to select the first precharge control signal in the sampling effective period and the second precharge control signal in a period other than the sampling effective period.

Embodiment 5

Figure 18:
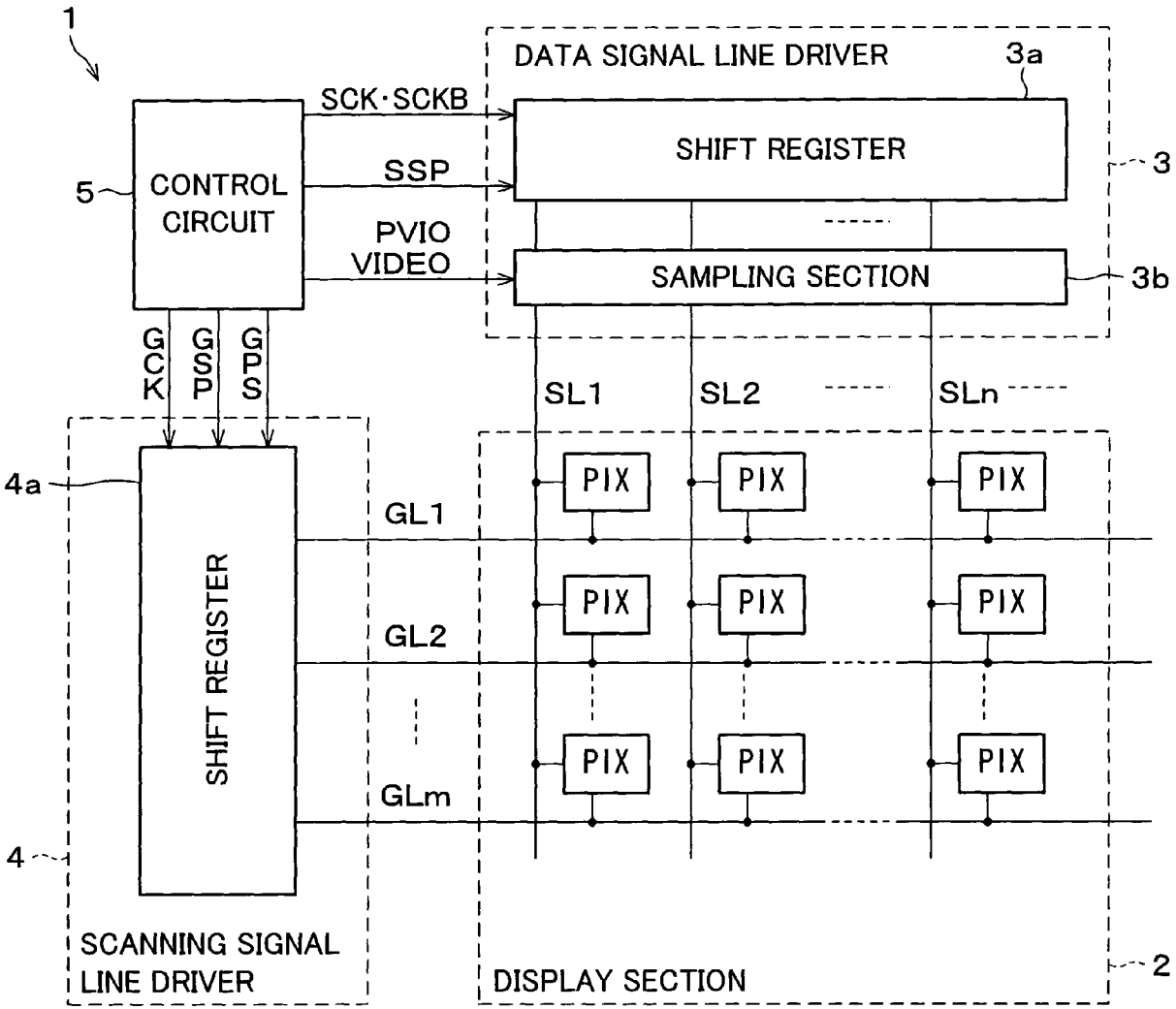
FIG. 18 is a circuit block diagram illustrating an arrangement of a display device of a fifth embodiment of the present invention.

With reference to FIG. 18, the following describes further embodiment of the present invention. Those members whose functions are identical to those of the members described in EMBODIMENT 1 to 4 are labeled with identical reference marks, and explanations of these members are omitted.

FIG. 18 illustrates an arrangement of a liquid crystal display device 1, which is a display device of the present embodiment.

The liquid crystal display device 1 is an active matrix liquid crystal display device that drives pixels by a current-alternating, dot-sequential method. The liquid crystal display device 1 includes a display section 2, a data signal line driver 3, a scanning signal line driver 4, a control circuit 5, data signal lines SL and scanning signal lines GL. The display section 2 includes pixels Pix provided in matrix. The data signal line driver 3 and the scanning signal line driver 4 drive the pixels Pix. The control circuit 5 generates video signals VIDEO respectively representing display states of the pixels Pix. In accordance with the video signals VIDEO, an image can be displayed.

The display section 2 is identical to the pixels Pixm-n (m=1, 2, . . . , n=1, 2, . . . ) and the dummy pixels described in EMBODIMENTS 1 to 4. The data signal line driver 3 is one of the data signal line drivers 31 to 34 described in EMBODIMENTS 1 to 4. The shift register 3*a* and the sampling section (write section, precharge circuit) 3*b* of the data signal line driver 3 are equivalent to the shift registers 31*a* to 34*a* and the sampling sections 31*b* to 34*b* described in EMBODIMENTS 1 to 4.

The scanning signal line driver 4 is a circuit for driving the scanning signal lines GLn of EMBODIMENTS 1 to 4 and selecting MOSFET (TFT) of the pixels connected thereto. The scanning signal line driver 4 includes a shift register 4*a* for transmitting a timing signal for selecting the scanning signal lines GL by a line sequential method.

The display section 2, the data signal line driver 3, and the scanning signal line driver 4 are provided on the same substrate, so as to reduce the labor at the time of manufacture and wire capacitances. In order to integrate more pixels Pix and expand display area, the display section 2, the data signal line driver 3, and the scanning signal line driver 4 are made of polycrystalline silicon thin-film transistors formed on a glass substrate. Furthermore, the polycrystalline silicon thin-film transistors are manufactured at a process temperature of not higher than 600° C., so that, even if an ordinary glass substrate (glass substrate whose distortion point is not higher than 600° C.) is used, the glass substrate does not warp or bow due to a process not lower than the distortion point.

The control circuit 5 generates clock signals SCK, SCKB, a start pulse SSP, a precharge potential PVID, and video signals VIDEO, and outputs them to the data signal line driver 3. The control circuit 5 further generates a clock signal GCK, a start pulse GSP, and a signal GPS, and outputs them to the scanning signal line driver 4.

With this arrangement, the liquid crystal display device 1 can attain the effect described in EMBODIMENTS 1 to 5, and thereby perform high-quality display.

The display device of the present invention is not limited to a liquid crystal display device; the display device may be any display device (e.g. an organic EL display device), as long as it is necessary to charge wire capacitors.

Embodiment 6

With reference to FIGS. 19 to 24, the following describes another further embodiment of the present invention. Those members whose functions are identical to those of the members described in EMBODIMENT 1 to 5 are labeled with identical reference marks, and explanations of these members are omitted.

Figure 19:
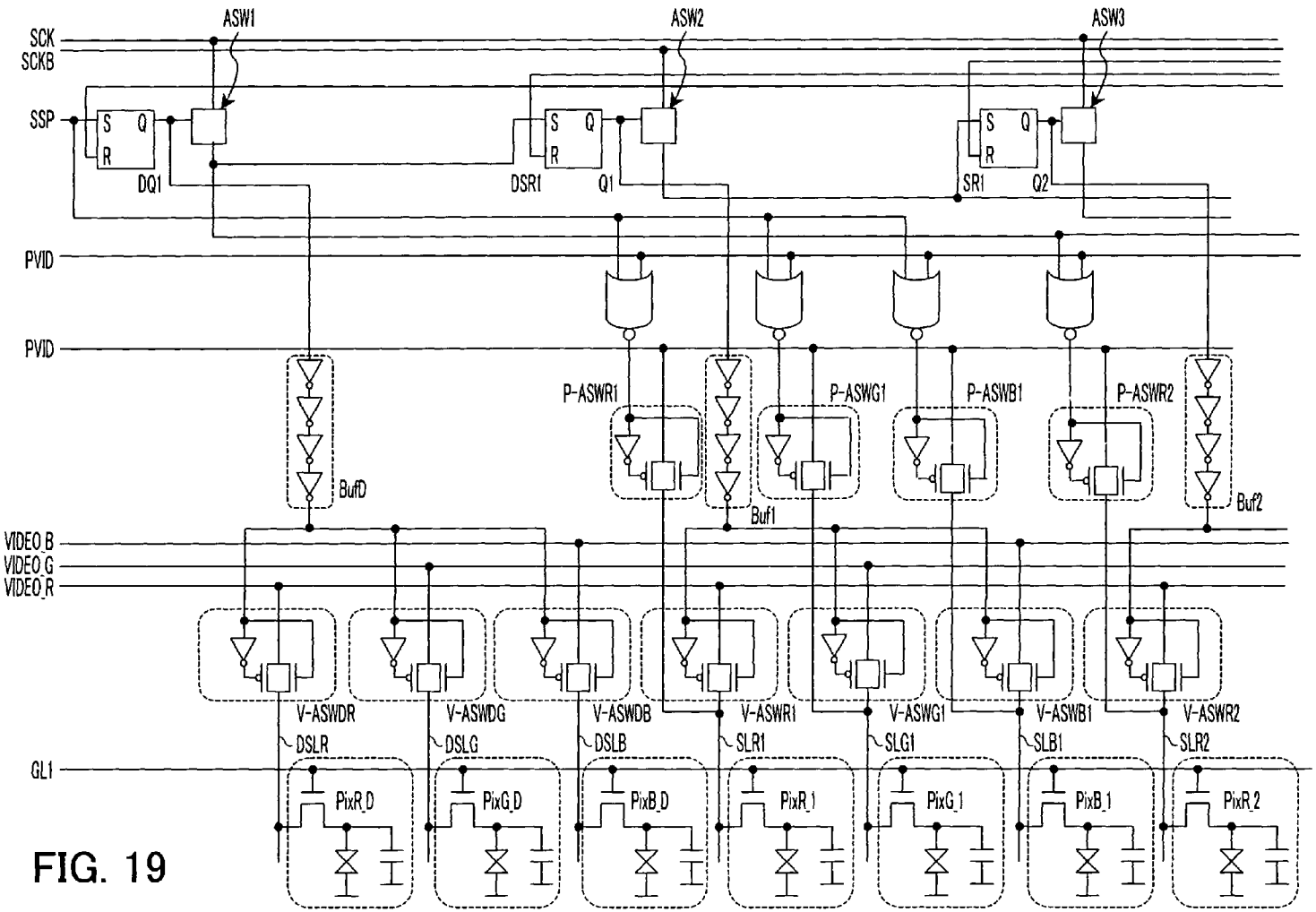
FIG. 19 is a circuit block diagram illustrating an example of an arrangement of a data signal line driver of a sixth embodiment of the present invention.
Figure 20:
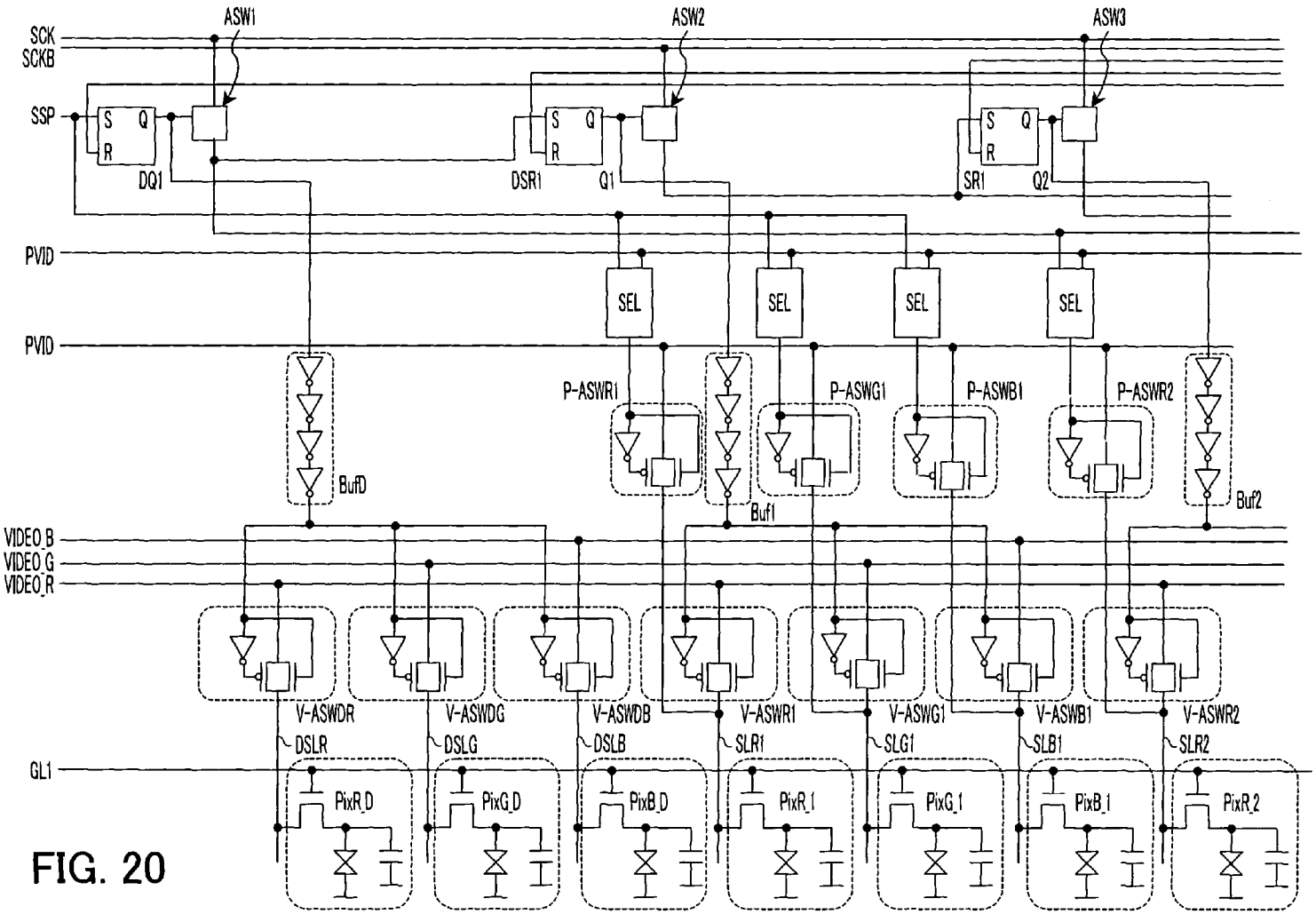
FIG. 20 is a circuit block diagram illustrating an arrangement of a variation example of the data signal line driver of FIG. 19.
Figure 21:
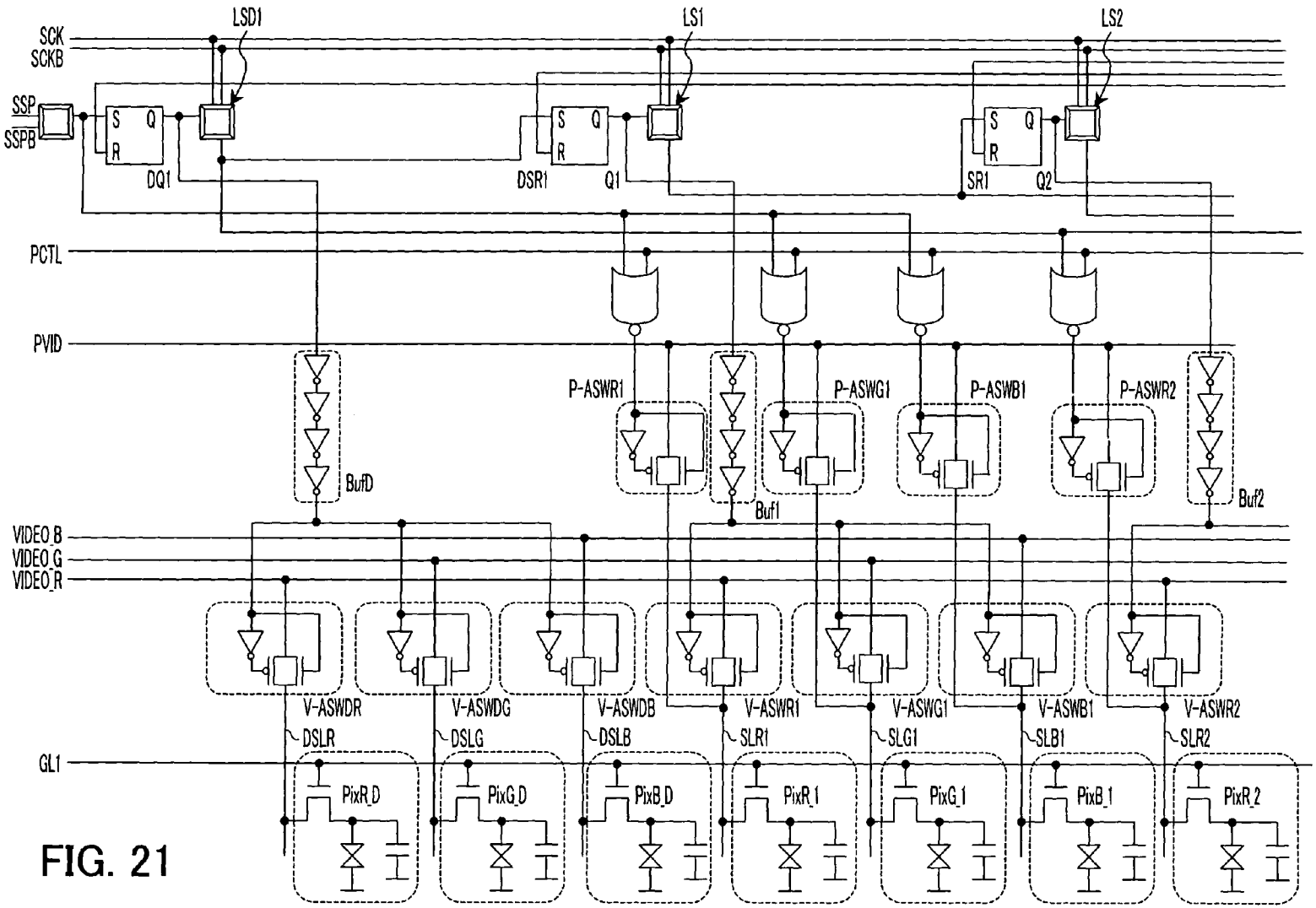
FIG. 21 is a circuit block diagram illustrating an example of another arrangement of the data signal line driver of the sixth embodiment of the present invention.
Figure 22:
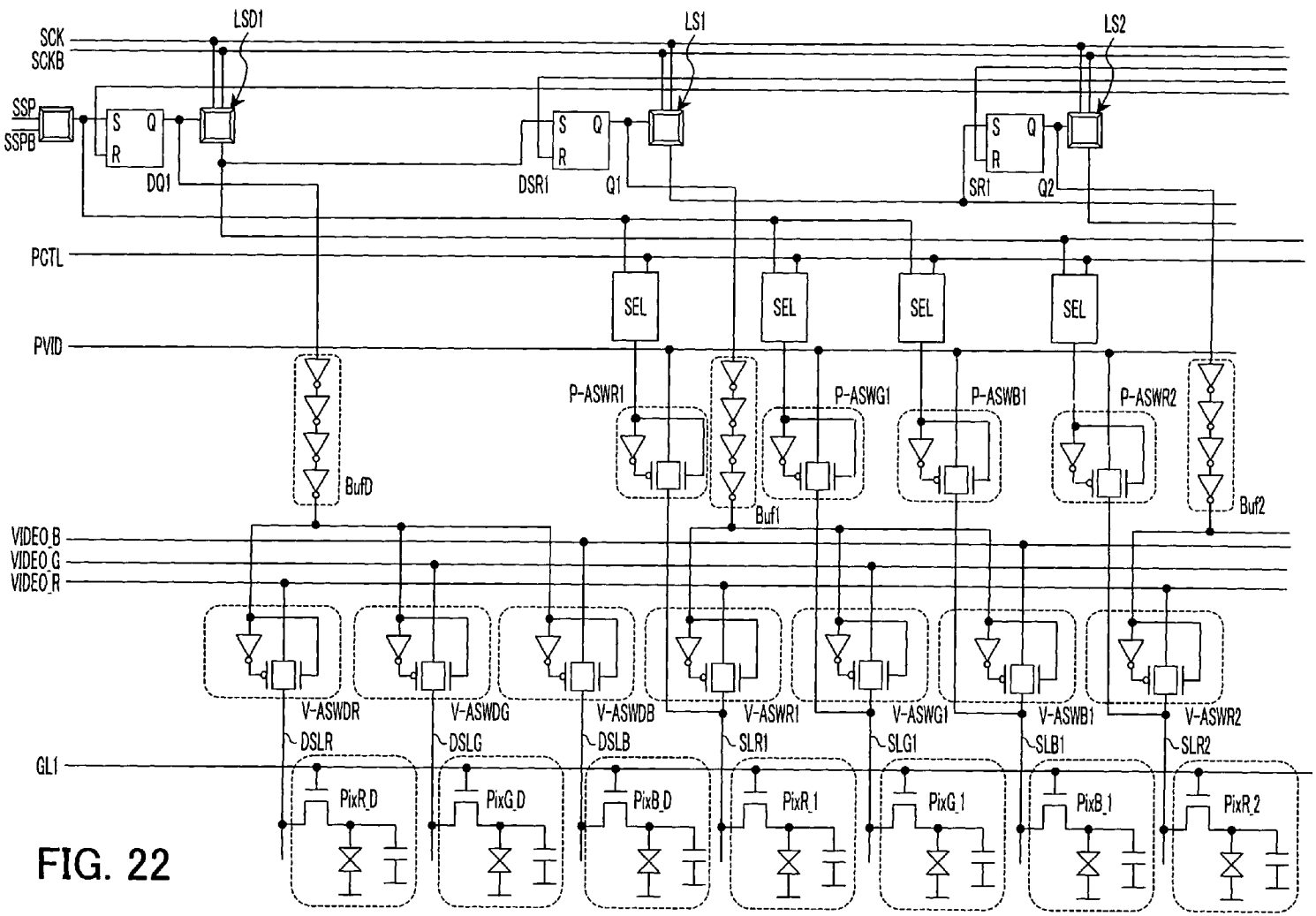
FIG. 22 is a circuit diagram illustrating an arrangement of a variation example of the data signal line driver of FIG. 19.

The driver circuits of the display devices of EMBODIMENTS 1 to 4 are driver circuits using a so-called dot sequential driving method, in which signals are sequentially written onto a plurality of data signal lines. Take, for example, the driving circuit of the display device of EMBODIMENT 1. The output Q of the shift register for controlling the conductivity (conductive or nonconductive) of the sampling switch V-ASW, the set signal for a next stage of the flip-flop SRFF of the shift register, and the signal SR for controlling the conductivity (conductive or nonconductive) of the precharge switch P-ASW are associated with switches of one line. However, the present invention is also applicable to a case in which three kinds of signals R, G, and B are sampled, as shown in FIG. 19. In the arrangement of FIG. 19, selector circuits may be used instead of the NOR circuits, as shown in FIG. 20. The driver circuit of the display device of EMBODIMENT 4 is also applicable to a case in which three kinds of signals R, G, and B are sampled, as shown in FIG. 21. In the arrangement of FIG. 21, selector circuits may be used instead of the NOR circuits, as shown in FIG. 22.

Figure 23:
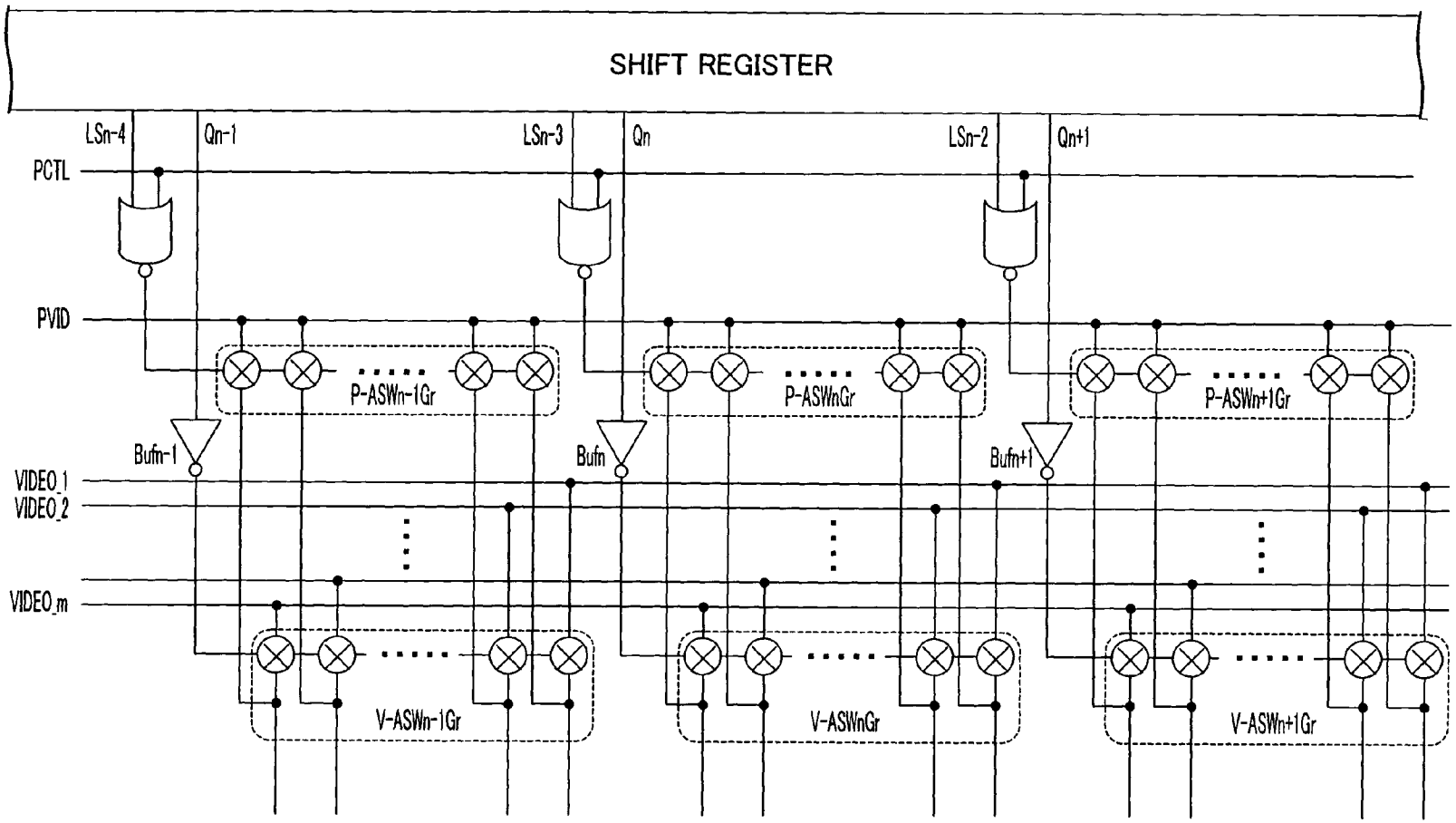
FIG. 23 is a circuit block diagram illustrating an example of another arrangement of the data signal line driver of the sixth embodiment of the present invention.

The present invention is also applicable to a case in which video signals are spread to a plurality of lines so as to delay the sampling period of the video signals, as shown in FIG. 23. In the arrangement of FIG. 23, selector circuits may be used instead of the NOR circuits, as shown in FIG. 24.

Figure 24:
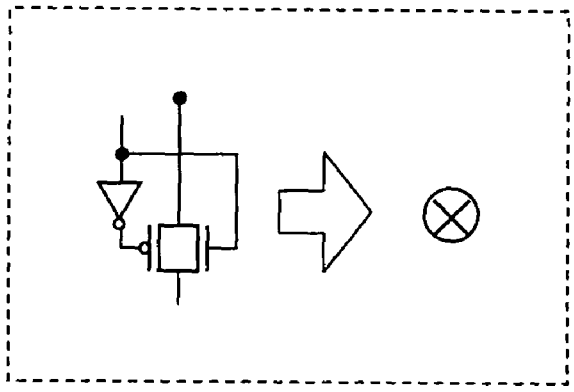
FIG. 24 is a circuit block diagram illustrating an arrangement of a variation example of the data signal line driver of FIG. 23.
Figure 25:
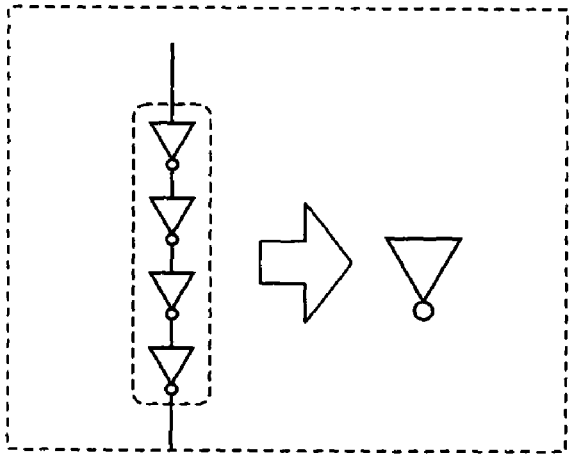
FIG. 25 is a circuit block diagram illustrating an arrangement of a part of the data signal line driver of FIG. 23 or FIG. 24.
Figure 26:
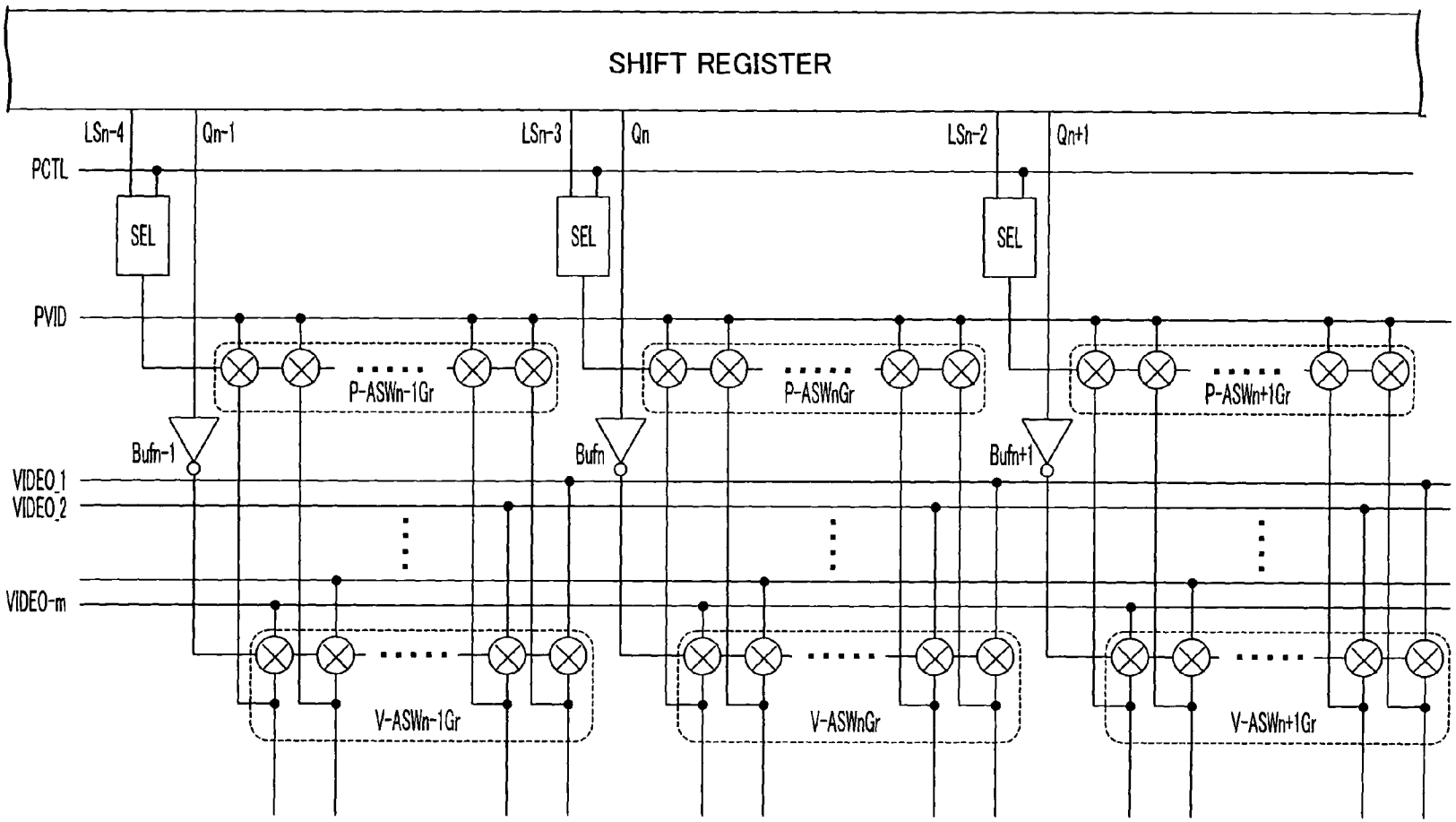
FIG. 26 is a circuit block diagram illustrating an arrangement of a part of the data signal line driver of FIG. 23 or FIG. 24.
Figure 27:
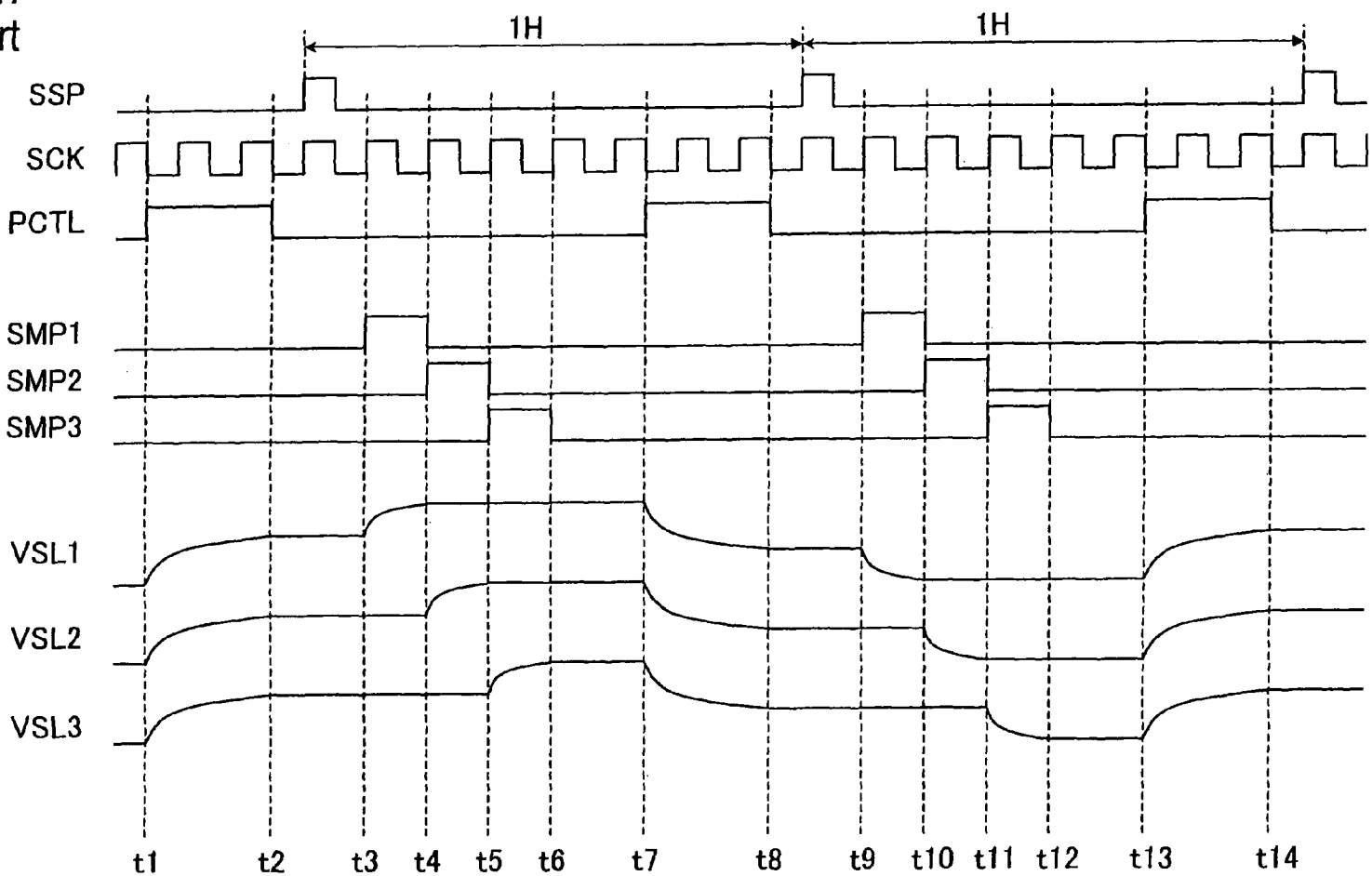
FIG. 27 Prior Art
FIG. 27 is a waveform chart illustrating driving waveforms in a normal scanning state in a conventional simultaneous precharge method.
Figure 28:
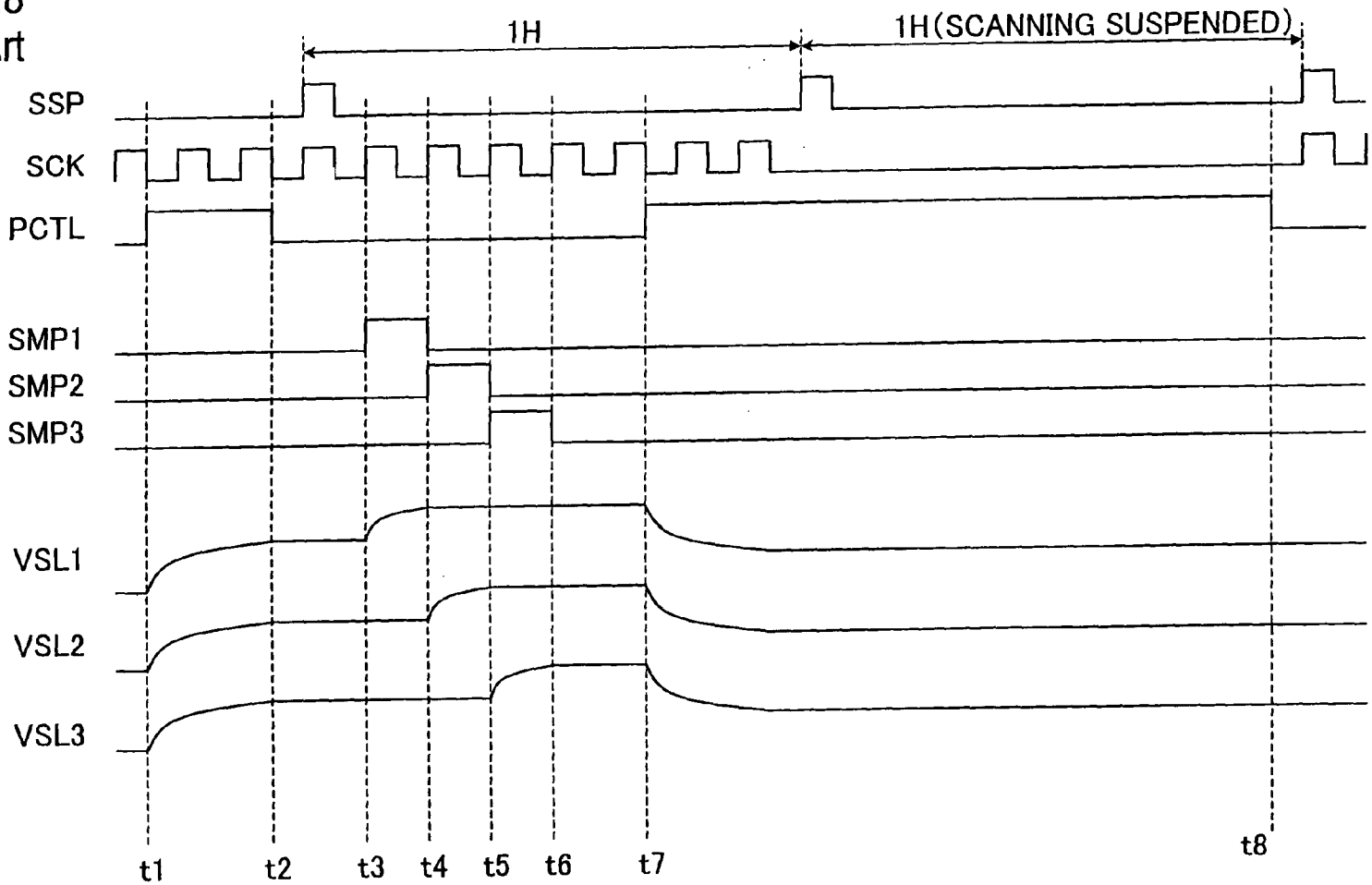
FIG. 28 Prior Art
FIG. 28 is a waveform chart illustrating driving waveforms at the time of normal scanning and scanning suspension in the conventional simultaneous precharge method.
Figure 29:
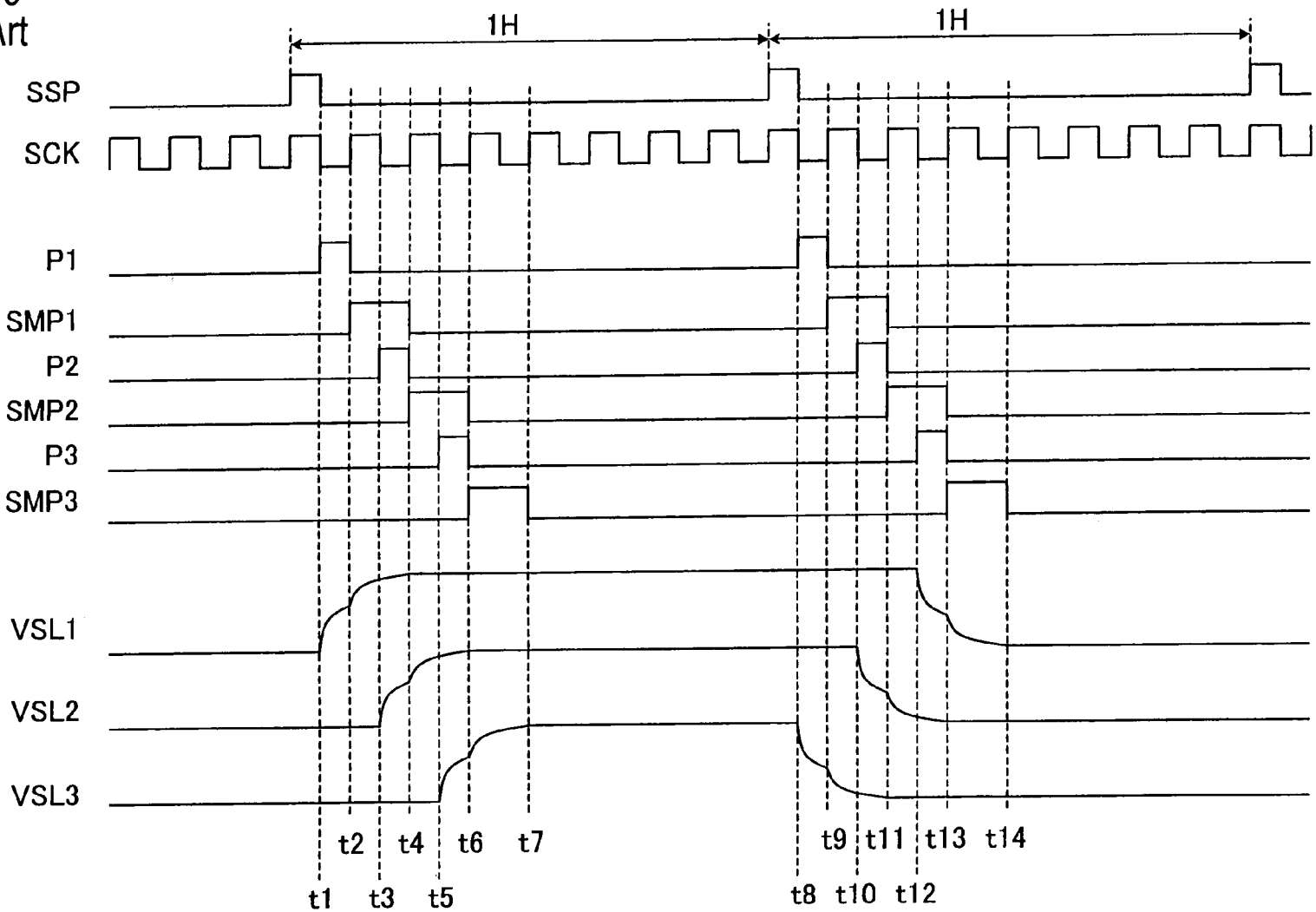
FIG. 29 Prior Art
FIG. 29 is a waveform chart illustrating waveforms in a normal scanning state in the conventional simultaneous precharge method.

Since FIGS. 23 and 24 are simplified figures, the switches for precharge and the switches for sampling are indicated by marks different from those used in FIG. 19. In reality, however, the switches used are identical to the switches used in FIG. 19, as shown in FIG. 25. Likewise, although the buffers in FIGS. 23 and 24 for driving the sampling analog switches are indicated by marks different from those used in FIG. 19, the buffers are identical to the buffers used in FIG. 19, as shown in FIG. 26. Likewise, the shift registers of FIGS. 23 and 24 are, in reality, not different from the shift registers of FIG. 19. However, it is necessary that the buffers have sufficient driving capability with respect to the number of lines for precharge and sampling.

If i-number of signal supply lines are used as one unit (where i is an integer not less than two), and i-number of kinds of signals are sampled, as shown in FIGS. 19 to 24, the sampling switches are made conductive simultaneously in each unit and sequentially unit by unit by the timing pulses from the flip-flops. The number of switching circuits corresponds to the number of units, and switches for precharge are made conductive simultaneously in each unit and sequentially unit by unit. Although basic operation is identical to that of the case in which only one kind of signal is sampled, one difference is that a plurality of switches for sampling and a plurality of switches for precharge are made conductive simultaneously.

The present invention is not limited to FIGS. 19 to 24. The present invention is also applicable to a case in which, in one of the driver circuits of the display devices of EMBODI- MENTS 1 to 4, precharge and sampling is performed with respect to plural kinds of signals, as shown in FIGS. 19 to 24.

The present invention may be varied in many ways within the scope of the claims, without limitation to the foregoing embodiments. Those embodiments obtained by combining technical means disclosed in different embodiments are also included within the scope of the present invention.

As described above, a driver circuit for a display device in accordance with the present invention is a driver circuit for a display device including a plurality of signal supply lines, the driver circuit including: a write circuit for writing write signals onto the signal supply lines line by line or by units of lines; and a precharge circuit for precharging the signal supply lines, while a write signal is written by the write circuit onto a signal supply line, the precharge circuit precharging another signal supply line, and, while no write signal is written by the write circuit onto any of the signal supply lines, the precharge circuit precharging the signal supply lines simultaneously.

The driver circuit of the present invention may further include: precharge control means for causing the precharge circuit to perform precharge when precharge is instructed by at least one of a first precharge control signal and a second precharge control signal, while a write signal is written by the write circuit onto a signal supply line, the first precharge control signal instructing precharge of another signal supply line, the second precharge control signal instructing simultaneous precharge of the signal supply lines. With this arrangement, the driver circuit of the present invention can be realized easily.

According to the data signal line drivers of Patent Publications 1 and 2, a control signal supply circuit for controlling conductivity (conductive or nonconductive) of a switch that is switched in order to output a video signal to a data signal line is also used as a control signal supply circuit for controlling conductivity (conductive or nonconductive) of a switch that is switched in order to precharge another data signal line. The precharge performed in alternating driving drastically changes the potentials of data signal lines and pixel capacitors, so that the polarities of the potentials are reversed from those at the time of sampling of a previous video signal. Therefore, switching of the switch involves a large impulse-shaped charge current.

The control terminal of the switch is that of a capacitor type. Therefore, there is a possibility that a relatively high frequency component of the large charge current is transmitted to the control signal circuit of the switch through the capacitor of the control terminal, and thereby fluctuates the potential of the control signal circuit and, through the control terminal of a switch for writing a video signal, fluctuates the video signal supplied to a data signal line. If the video signal fluctuates in this way, display becomes less even, thereby deteriorating display quality.

On the other hand, according to the data signal line driver of Patent Publication 3, the fluctuation of the video signal is reduced, because the control signal circuits can be provided separately. However, in addition to the shift register for transferring a transfer pulse, it is necessary to provide a shift register for delaying the transfer pulse from the timing pulse for precharge. As a result, the circuit size of shift registers becomes twice larger.

Thus, there has been a conventional problem that a driver circuit for a display device, such as a data signal line driver, cannot have a small circuit size of shift registers while avoiding fluctuation of a signal supplied to another signal supply line, in performing precharge from a precharge power source having relatively low driving capability by using a precharge circuit provided inside the driver circuit.

Therefore, to solve the foregoing problems, it is preferable if the driver circuit of the present invention further includes: a shift register including plural stages of flip-flops for outputting a write timing pulse to first switches, the flip-flops sequentially transmitting the timing pulse so that writing is performed in a predetermined period, the write circuit including the first switches respectively for the plurality of signal supply lines, each of the first switches switching between conductive and nonconductive in accordance with a charge voltage of a capacitor-type first control terminal, the write signals being written onto the signal supply lines through conduction of the first switches, the precharge circuit including second switches respectively for the plurality of signal supply lines, each of the second switches switching between conductive and nonconductive in accordance with a charge voltage of a capacitor-type second control terminal, the signal supply lines being precharged through conduction of the second switches, the shift register including a control signal supply circuit for outputting the first precharge control signal, the flip-flops outputting the timing pulse to the first control terminal of each of the first switches, the precharge control means outputting a control signal for controlling the second switches to the second control terminal of each of the second switches, the control signal supply circuit outputting the first precharge control signal to the precharge control means through a second signal line, which is separated from a first signal line for transmitting the timing pulse to the first control terminal.

According to this invention, the control signal for controlling conductivity of the second switches is inputted to each of the second switches through the second signal line, which is separated from the first signal line for transmitting the timing pulse to the first control terminal. Therefore, the line through which the timing pulse for writing by the write circuit is supplied to the first switches and the line through which the precharge control signal for controlling conductivity of the second switches of the precharge circuit is supplied to the second switches are separated. Thus, the control signal circuit for the first switches and the control signal circuit for the second switches are provided separately. In other words, a supply system for the signal for controlling the write circuit and a supply system for the signal for controlling the precharge circuit are provided separately. With this arrangement, it is possible to avoid the problem that, in precharging another signal supply line while a write signal is written by the write circuit onto a signal supply line, a large current flowing on the signal supply line fluctuates, through the capacitor-type first control terminal of a first switch and the capacitor-type second control terminal of a second switch, the potential of the signal supply line to which the write signal is supplied. Moreover, since the control signal supply circuit for outputting the first precharge control signal can be made more simply than flip-flops, the circuit size of the shift register is much smaller than that of the conventional arrangement, in which the circuit size of the shift registers is twice larger.

Thus, it is possible to provide a driver circuit of a display device, the driver circuit including a precharge circuit and, in precharging one signal supply line by a precharge power source having low driving capability, being capable of avoiding fluctuation of a signal supplied to another signal supply line, while having a small circuit size of the shift register.

The precharge circuit is not particularly limited in terms of the number of signal supply lines to write onto and the number of signal supply lines precharged, as long as another supply line is precharged while a write signal is written by the write circuit onto a signal supply line.

When two signal lines are separated, it means that the two signal lines are electrically not connected (for example, one of the two signal lines is connected to a source or drain of a transistor while the other of the two signal lines is connected to the transistor, or the two signal lines are insulated from each other).

The control signal supply circuit may, for example, (1) transfer the clock signal supplied from outside (e.g. outside the driver circuit) as the precharge control signal to the second control terminal, (2) process (e.g. perform level shift of) the clock signal supplied from outside (e.g. outside the driver circuit) and transfer it as the precharge control signal to the second control terminal, or (3) generate the precharge control signal and output it to the second control terminal. Among these arrangements, (1) and (2) are advantageous in that the circuit size of the control signal supply circuit can be reduced.

The driver circuit of the present invention may have an arrangement in which the control signal supply circuit takes in a clock signal when the timing pulse is inputted from one of the flip-flops in a writing effective period, and outputs the first precharge control signal to a second control terminal corresponding to a predetermined one of the signal supply lines, so as to make a corresponding second switch conductive, the clock signal being inputted from a supply source that is different from a supply source of the timing pulse, the writing effective period being a period, within the predetermined period, in which the write signals are written onto the signal supply lines, the first precharge control signal being in synchronization with the clock signal, the predetermined one of the signal supply lines being a signal supply line that is not supplied with a write signal; and the control signal supply circuit being a plurality of control signal supply circuits provided so as to correspond to the signal supply lines that are precharged in the writing effective period.

According to this arrangement, the write signals are supplied to the signal supply lines in the writing effective period. When a flip-flop outputs the timing pulse, the timing pulse is received by a next-stage flip-flop. Then, a switching circuit corresponding to the next-stage flip-flop takes in the clock signal and outputs a control signal, which is in synchronization with the clock signal, to the control terminal of the second switch, so as to precharge a predetermined signal supply line that is not supplied with a write signal. In this way, while a write signal is written onto a signal supply line, another signal supply line can be precharged. In addition, since the clock signal supplied from a different supply source is taken in and outputted, it is possible to reduce the circuit size.

The first precharge control signal that is in synchronization with the clock signal is, for example, the clock signal itself, a level shift signal of the clock signal, or an inversion signal of the clock signal.

The driver circuit may have an arrangement in which the flip-flops are set-reset flip-flops; each of the control signal supply circuits is a switching circuit for outputting the clock signal as the first precharge control signal; the switching circuit also outputs the clock signal as a set signal to be transferred to a next set-reset flip-flop of the set-reset flip-flop that outputted the timing pulse; and each of the set-reset flip-flops uses the set signal as a reset signal for a predetermined preceding set-reset flip-flop.

According to this arrangement, a first switch of the write circuit becomes conductive when the timing pulse for writing a write signal is outputted from a set-reset flip-flop and the control terminal of the first switch is charged. A second switch of the precharge circuit becomes conductive when the clock signal inputted from a supply source that is different from a supply source of the timing pulse is taken in and outputted by the switching circuit and the control terminal of the second switch is charged. In the writing effective period, the write signals are supplied to the signal supply lines. When a flip-flop outputs the timing pulse, the timing pulse is received by a next-stage flip-flop. Then, the switching circuit corresponding to the next-stage flip-flop takes in and outputs the clock signal, so as to precharge a predetermined signal supply line that is not supplied with a write signal. In this way, while a write signal is written onto a signal supply line, another signal supply line can be precharged.

The switching circuit also outputs the clock signal as a set signal to be transferred to a next set-reset flip-flop of the set-reset flip-flop that outputted the timing pulse, and each of the set-reset flip-flops uses the set signal as a reset signal for a predetermined preceding set-reset flip-flop. In this way, the timing pulse can be transferred sequentially.

At this time, the line to which the timing pulse for writing is supplied and the line to which the signal for precharge is supplied are separate lines. Thus, the control signal circuit for the first switches and the control signal circuit for the second switches are provided separately. With this arrangement, it is possible to avoid the problem that, in precharging another signal supply line while a write signal is written by the write circuit onto a signal supply line, a large current flowing on the signal supply line fluctuates, through the capacitor-type first control terminal of a first switch and the capacitor-type second control terminal of a second switch, the potential of the signal supply line to which the write signal is supplied. Moreover, since the switching circuit for taking in and outputting the clock signal can be made more simply than flip-flops, the circuit size of the shift register is much smaller than that of the conventional arrangement, in which the circuit size of the shift registers is twice larger.

Thus, it is possible to provide a driver circuit of a display device, the driver circuit including a precharge circuit and, in precharging one signal supply line by a precharge power source having low driving capability, being capable of avoiding fluctuation of a signal supplied to another signal supply line, while having a small circuit size of the shift register.

The driver circuit of a display device of the present invention may have an arrangement in which the first switches are sequentially made conductive by the timing pulse from the set-reset flip-flops, and the number of the switching circuit corresponds to the number of the signal supply lines, so as to sequentially make the second switches conductive.

According to this arrangement, it is possible to provide a driver circuit using a so-called dot sequential driving method, in which signals are sequentially written onto the signal supply lines in accordance with the timing pulse from the flip-flops.

The driver circuit of a display device of the present invention may have an arrangement in which i-number of the signal supply lines are used as one unit, where i is an integer not less than two, and the first switches are made conductive simultaneously within the one unit and sequentially unit by unit; the number of the switching circuit corresponds to the number of units; and the second switches are made conductive simultaneously within the one unit and sequentially unit by unit.

According to this arrangement, it is possible to provide a driver circuit using a so-called multidot simultaneous driving method, in which signals are sequentially written onto the signal supply lines by units of lines, in accordance with the timing pulse from the flip-flops.

The driver circuit of a display device of the present invention may have an arrangement in which the flip-flops are set-reset flip-flops; each of the control signal supply circuits is a level shift circuit that performs level shift of the clock signal, and outputs the clock signal as the first precharge control signal; the level shift circuit also outputs the clock signal as a set signal to be transferred to a next set-reset flip-flop of the set-reset flip-flop that outputted the timing pulse; and each of the set-reset flip-flops uses the set signal as a reset signal for a predetermined preceding set-reset flip-flop.

According to this arrangement, a first switch of the write circuit becomes conductive when the timing pulse for writing a write signal is outputted from a set-reset flip-flop and the control terminal of the first switch is charged. A second switch of the precharge circuit becomes conductive when the clock signal inputted from a supply source that is different from a supply source of the timing pulse is taken in and outputted by the switching circuit and the control terminal of the second switch is charged. In the writing effective period, the write signals are supplied to the signal supply lines. When a flip-flop outputs the timing pulse, the timing pulse is received by a next-stage flip-flop. Then, a level shift circuit corresponding to the next-stage flip-flop takes in the clock signal and outputs a level shift signal of the clock signal, which precharges a predetermined signal supply line that is not supplied with a write signal.

The level shift circuit also outputs the level shift signal of the clock signal as a set signal to be transferred to a next set-reset flip-flop of the set-reset flip-flop that outputted the timing pulse, and each of the set-reset flip-flops uses the set signal as a reset signal for a predetermined preceding set-reset flip-flop. In this way, while a write signal is written onto a signal supply line, another signal supply line can be precharged.

As can be seen from the fact that the clock signals inputted to the level shift circuits may be low-voltage signals, the level shift circuits have a function of low-voltage interface. Therefore, it is possible to reduce power consumption of the external circuit that generates the clock signals.

The driver circuit of a display device of the present invention may have an arrangement in which the first switches are sequentially made conductive by the timing pulse from the set-reset flip-flops, and the number of the level shift circuit corresponds to the number of the signal supply lines, so as to sequentially make the second switches conductive.

According to this arrangement, it is possible to provide a driver circuit using a so-called dot sequential driving method, in which signals are sequentially written onto the signal supply lines in accordance with the timing pulse from the flip-flops.

The driver circuit of a display device of the present invention may have an arrangement in which i-number of the signal supply lines are used as one unit, where i is an integer not less than two, and the first switches are made conductive simultaneously within the one unit and sequentially unit by unit; the number of the level shift circuit corresponds to the number of units; and the second switches are made conductive simultaneously within the one unit and sequentially unit by unit.

According to this arrangement, it is possible to provide a driver circuit using a so-called multidot simultaneous driving method, in which signals are sequentially written onto the signal supply lines by units of lines, in accordance with the timing pulse from the flip-flops.

As described above, a display device of the present invention includes: a plurality of pixels; a plurality of data signal lines and a plurality of scanning signal lines corresponding to the plurality of pixels; a data signal line driver for writing video signals onto the data signal lines and the pixels; and a scanning signal line driver for writing scanning signals onto the scanning signal lines so as to select pixels onto which the video signals are to be written, the data signal line driver including a write circuit for writing the video signals onto the data signal lines line by line or by units of lines; and a precharge circuit for precharging the data signal lines, while a video signal is written by the write circuit onto a data signal line, the precharge circuit precharging another data signal line, and, while no video signal is written by the write circuit onto any of the data signal lines, the precharge circuit precharging the data signal lines simultaneously.

Therefore, the data signal line driver can perform precharge even with a precharge power source having relatively low driving capability, and to precharge the signal supply lines of the display device sufficiently. Thus, it is possible to provide a display device having high display quality.

The driver circuits of the present invention is suitable as driver circuits for display devices such as liquid crystal display devices and organic EL display devices, especially as driver circuits for data signal lines.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driver circuit for a display device including a plurality of signal supply lines, the driver circuit comprising:

a write circuit for writing write signals onto the signal supply lines line by line or by units of lines so that periods in each of which the write signals are written to the signal supply lines overlap;

a precharge circuit for precharging the signal supply lines, the precharge circuit including precharge switches each configured to precharge corresponding signal supply lines based on receipt of a control signal of a low level; and a NOR circuit configured to output a nondisjunction of a first precharge control signal and a second precharge control signal directly to the precharge circuit, the precharge switches of the precharge circuit including a P-channel MOS transistor having a gate configured to receive the output directly from the NOR circuit, the precharge circuit being configured to precharge the signal supply lines so that during the period in which a write signal is written by the write circuit onto a signal supply line, the precharge circuit precharges a first other signal supply line in a first period and precharges a second other signal supply line in a second period, the first period and the second period not overlapping, and, while no write signal is written by the write circuit onto any of the signal supply lines, the precharge circuit precharges the signal supply lines simultaneously.

2. The driver circuit as set forth in claim 1, wherein the NOR circuit is configured to cause the precharge circuit to perform precharge when precharge is instructed by at least one of the first precharge control signal and the second precharge control signal, the NOR circuit is configured so that while a write signal is written by the write circuit onto a signal supply line, the first precharge control signal instructs precharge of another signal supply line, and the NOR circuit is configured so that the second precharge control signal instructs simultaneous precharge of the signal supply lines.

3. The driver circuit as set forth in claim 2, further comprising:

a shift register including plural stages of flip-flops for outputting a write timing pulse to first switches, the flip-flops being configured to sequentially transmitting the timing pulse so that writing is performed in a predetermined period, the write circuit including the first switches respectively for the plurality of signal supply lines, each of the first switches being configured to switch between conductive and nonconductive in accordance with a charge voltage of a capacitor-type first control terminal, the write circuit being configured to write the write signals onto the signal supply lines through conduction of the first switches, the precharge circuit including the precharge switches respectively for the plurality of signal supply lines, each of the precharge switches being configured to switch between conductive and nonconductive in accordance with a charge voltage of a capacitor-type second control terminal, the precharge circuit being configured to precharge the signal supply lines through conduction of the precharge switches, the shift register including a control signal supply circuit for outputting the first precharge control signal, the flip-flops being configured to output the timing pulse to the first control terminal of each of the first switches, the NOR circuit being configured to output a control signal for controlling the precharge switches to the second control terminal of each of the precharge switches, the control signal supply circuit being configured to output the first precharge control signal to the NOR circuit through a second signal line, which is separated from a first signal line for transmitting the timing pulse to the first control terminal.

4. The driver circuit as set forth in claim 3, wherein:

the control signal supply circuit is configured to take in a clock signal when the timing pulse is inputted from one of the flip-flops in a writing effective period, and output the first precharge control signal to a second control terminal corresponding to a predetermined one of the signal supply lines, so as to make a corresponding precharge switch conductive, the control supply circuit being configured to take the clock signal from a supply source that is different from a supply source of the timing pulse, the writing effective period being a period, within the predetermined period, in which the write signals are written onto the signal supply lines, the first precharge control signal being in synchronization with the clock signal, the predetermined one of the signal supply lines being a signal supply line that is not supplied with a write signal; and the control signal supply circuit being a plurality of control signal supply circuits provided so as to correspond to the signal supply lines that are precharged in the writing effective period.

5. The driver circuit as set forth in claim 4, wherein:

the flip-flops are set-reset flip-flops;

each of the control signal supply circuits is a switching circuit for outputting the clock signal as the first precharge control signal;

the switching circuit also being configured to output the clock signal as a set signal to be transferred to a next set-reset flip-flop of the set-reset flip-flop that outputted the timing pulse; and each of the set-reset flip-flops being configured to use the set signal as a reset signal for a predetermined preceding set-reset flip-flop.

6. The driver circuit as set forth in claim 4, wherein:

the flip-flops are set-reset flip-flops;

each of the control signal supply circuits is a level shift circuit that is configured to perform level shift of the clock signal, and output the clock signal as the first precharge control signal;

the level shift circuit also being configured to output the clock signal as a set signal to be transferred to a next set-reset flip-flop of the set-reset flip-flop that outputted the timing pulse; and each of the set-reset flip-flops is configured to use the set signal as a reset signal for a predetermined preceding set-reset flip-flop.

7. The driver circuit as set forth in claim 6, wherein:

the first switches are configured to be sequentially made conductive by the timing pulse from the set-reset flip-flops, and the number of the level shift circuit corresponds to the number of the signal supply lines, so as to sequentially make the precharge switches conductive.

8. The driver circuit as set forth in claim 6, wherein:

i-number of the signal supply lines are used as one unit, where i is an integer not less than two, and the first switches are configured to be made conductive simultaneously within said one unit and sequentially unit by unit;

the number of the level shift circuit corresponds to the number of units; and the precharge switches are configured to be made conductive simultaneously within said one unit and sequentially unit by unit.

9. A display device, comprising:

a plurality of pixels;

a plurality of data signal lines and a plurality of scanning signal lines corresponding to the plurality of pixels;

a data signal line driver for writing video signals onto the data signal lines and the pixels; and a scanning signal line driver for writing scanning signals onto the scanning signal lines so as to select pixels onto which the video signals are to be written, the data signal line driver including a write circuit for writing the video signals onto the data signal lines line by line or by units of lines so that periods in each of which the write signals are written to the data signal lines overlap;

a precharge circuit for precharging the data signal lines, the precharge circuit including precharge switches each configured to precharge corresponding signal supply lines based on receipt of a control signal of a low level; and a NOR circuit configured to output a nondisjunction of a first precharge control signal and a second precharge control signal directly to the precharge circuit, the precharge switches of the precharge circuit including a P-channel MOS transistor having a gate configured to receive the output directly from the NOR circuit, the precharge circuit being configured to precharge the data signal lines so that during the period in which a video signal is written by the write circuit onto a data signal line, the precharge circuit precharges a first other data signal line in a first period and precharges a second other data signal line in a second period, the first period and the second period not overlapping, and, while no video signal is written by the write circuit onto any of the data signal lines, the precharge circuit precharges the data signal lines simultaneously.

10. The display device as set forth in claim 9, wherein for the NOR circuit is configured to cause the precharge circuit to perform precharge when precharge is instructed by at least one of the first precharge control signal and the second precharge control signal, the NOR circuit is configured so that while a video signal is written by the write circuit onto a data signal line, the first precharge control signal instructs precharge of another data signal line, and the NOR circuit is configured so that the second precharge control signal instructs simultaneous precharge of the data signal lines.

11. The display device as set forth in claim 10, further comprising:

a shift register including plural stages of flip-flops for outputting a write timing pulse to first switches, the flip-flops being configured to sequentially transmit the timing pulse so that writing is performed in a predetermined period, the write circuit including the first switches respectively for the plurality of data signal lines, each of the first switches being configured to switch between conductive and nonconductive in accordance with a charge voltage of a capacitor-type first control terminal, the write circuit being configured to write the video signals onto the data signal lines through conduction of the first switches, the precharge circuit including the precharge switches respectively for the plurality of data signal lines, each of the precharge switches being configured to switch between conductive and nonconductive in accordance with a charge voltage of a capacitor-type second control terminal, the precharge circuit being configured to precharge the data signal lines through conduction of the precharge switches, the shift register including a control signal supply circuit for outputting the first precharge control signal, the flip-flops, being configured to output the timing pulse to the first control terminal of each of the first switches, the NOR circuit being configured to output a control signal for controlling the precharge switches to the second control terminal of each of the precharge switches, the control signal supply circuit being configured to output the first precharge control signal to the precharge control device through a second signal line, which is separated from a first signal line for transmitting the timing pulse to the first control terminal.

12. The display device as set forth in claim 11, wherein:

the control signal supply circuit is configured to take in a clock signal when the timing pulse is inputted from one of the flip-flops in a writing effective period, and output the first precharge control signal to a second control terminal corresponding to a predetermined one of the data signal lines, so as to make a corresponding precharge switch conductive, the control signal supply circuit being configured to take the clock signal from a supply source that is different from a supply source of the timing pulse, the writing effective period being a period, within the predetermined period, in which the write signals are written onto the data signal lines, the first precharge control signal being in synchronization with the clock signal, the predetermined one of the data signal lines being a data signal line that is not supplied with a write signal; and the control signal supply circuit is a plurality of control signal supply circuits provided so as to correspond to the data signal lines that are precharged in the writing effective period.

13. The display device as set forth in claim 12, wherein:

the flip-flops are set-reset flip-flops;

each of the control signal supply circuits is a switching circuit for outputting the clock signal as the first precharge control signal;

the switching circuit also being configured to output the clock signal as a set signal to be transferred to a next set-reset flip-flop of the set-reset flip-flop that outputted the timing pulse; and each of the set-reset flip-flops being configured to use the set signal as a reset signal for a predetermined preceding set-reset flip-flop.

14. The display device as set forth in claim 12, wherein:

the flip-flops are set-reset flip-flops;

each of the control signal supply circuits is a level shift circuit that is configured to perform level shift of the clock signal, and output the clock signal as the first precharge control signal;

the level shift circuit also being configured to output the clock signal as a set signal to be transferred to a next set-reset flip-flop of the set-reset flip-flop that outputted the timing pulse; and each of the set-reset flip-flops being configured to use the set signal as a reset signal for a predetermined preceding set-reset flip-flop.

15. The display device as set forth in claim 14, wherein:

the first switches are configured to be sequentially made conductive by the timing pulse from the set-reset flip-flops, and the number of the level shift circuit corresponds to the number of the signal supply lines, so as to sequentially make the precharge switches conductive.

16. The display device as set forth in claim 14, wherein:

i-number of the data signal lines are used as one unit, where i is an integer not less than two, and the first switches are configured to be made conductive simultaneously within said one unit and sequentially unit by unit;

the number of the level shift circuit corresponds to the number of units; and the precharge switches are configured to be made conductive simultaneously within said one unit and sequentially unit by unit.

* * * * *